US008590098B2

(12) United States Patent
Smith et al.

(10) Patent No.: US 8,590,098 B2
(45) Date of Patent: Nov. 26, 2013

(54) VACUUM HOSE STORAGE SYSTEM

(75) Inventors: James F. Smith, Louisville, OH (US); Andrew L. Gabric, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 554 days.

(21) Appl. No.: 12/883,302

(22) Filed: Sep. 16, 2010

(65) Prior Publication Data

US 2011/0041282 A1 Feb. 24, 2011

Related U.S. Application Data

(63) Continuation-in-part of application No. 12/341,571, filed on Dec. 22, 2008, now abandoned, which is a continuation-in-part of application No. 12/151,174, filed on May 5, 2008, now Pat. No. 7,945,990.

(60) Provisional application No. 61/062,724, filed on Jan. 29, 2008.

(51) Int. Cl.

| | |
|---|---|
| ***A47L 5/00*** | (2006.01) |
| ***A47L 9/00*** | (2006.01) |
| ***A62C 35/00*** | (2006.01) |
| ***B65H 75/34*** | (2006.01) |

(52) U.S. Cl.
USPC ..... 15/323; 137/355.23

(58) Field of Classification Search
USPC ..... 15/323; 137/355.23, 355.2, 355.21
See application file for complete search history.

(56) References Cited

U.S. PATENT DOCUMENTS

| | | | | |
|---|---|---|---|---|
| 2,943,698 | A | | 7/1960 | Bishop |
| 2,953,806 | A | * | 9/1960 | Walker ..... 15/315 |
| 3,173,164 | A | | 3/1965 | Congdon |
| 3,520,725 | A | | 7/1970 | Hamrick |
| 3,568,240 | A | | 3/1971 | Hamrick |
| 3,593,363 | A | | 7/1971 | Hamrick |
| 3,977,037 | A | | 8/1976 | Miyake et al. |
| 4,064,355 | A | | 12/1977 | Neroni et al. |
| 4,133,347 | A | | 1/1979 | Mercer |
| 4,133,972 | A | | 1/1979 | Andersson et al. |
| 4,194,081 | A | | 3/1980 | Medford et al. |
| 4,368,348 | A | | 1/1983 | Eichelberger et al. |
| 4,688,292 | A | | 8/1987 | Schmiegel |

(Continued)

FOREIGN PATENT DOCUMENTS

EP 0963939 12/1999

*Primary Examiner* — Bryan R Muller
(74) *Attorney, Agent, or Firm* — Sand & Sebolt

(57) ABSTRACT

A vacuum hose storage system includes a housing which is mounted in a storage area of a dwelling or vehicle and connected to a vacuum source. A length of flexible, expandable cleaning hose is mounted in a looped fashion about a plurality of spaced rollers rotatably mounted within the housing. A handle is attached to one end of the hose and is seated in a cradle formed in the housing when the hose is in a fully retracted position within the housing. The cradle is mounted in the housing and receives the open end of the hose when not in use and enables other vacuum tubes in the structure to be operational without shutting off the vacuum to the stored hose. An ON/OFF switch is located in the cradle for controlling the vacuum source and is actuated when the handle is placed in or removed from the cradle. The hose has an internal helical spring which biases the hose toward a retracted position about the spaced rollers within the housing. In an alternate embodiment, the hose is slidably extendable from within a rigid serpentine tubing mounting within the housing.

2 Claims, 31 Drawing Sheets

(56) References Cited

U.S. PATENT DOCUMENTS

| | | | |
|---|---|---|---|
| 5,119,843 | A | 6/1992 | Keenan |
| 5,222,906 | A | 6/1993 | Lundstrom |
| 5,430,978 | A | 7/1995 | Kohler |
| 5,526,842 | A | 6/1996 | Christensen |
| 5,740,581 | A | 4/1998 | Harrelson, II |
| 6,058,560 | A | 5/2000 | Gab et al. |
| 6,120,615 | A | 9/2000 | Fletcher |
| 6,182,327 | B1 | 2/2001 | Gosselin |
| 6,427,284 | B1 | 8/2002 | Harrelson, II et al. |
| 6,560,816 | B1 | 5/2003 | Harrelson, II |
| 6,817,058 | B1 | 11/2004 | Harrelson, II |
| 6,948,527 | B2 | 9/2005 | Ragner et al. |
| 7,010,829 | B2 | 3/2006 | Harman et al. |
| 7,306,012 | B2 | 12/2007 | Stockton et al. |
| 2002/0013974 | A1 | 2/2002 | Gibson et al. |
| 2006/0000047 | A1 | 1/2006 | Beechie |
| 2006/0070679 | A1 | 4/2006 | Ragner |
| 2007/0174991 | A1 | 8/2007 | Trotter |

* cited by examiner $L_{TOT} = \Sigma L + \frac{1}{2} W \pi D$ $L_{TOT}$ = TOTAL LENGTH OF HOSE INSIDE

W = # OF WHEELS

VACUUM HOSE STORAGE SYSTEM

CROSS REFERENCE TO RELATED APPLICATIONS

This application is a continuation-in-part of U.S. patent application Ser. No. 12/341,571, filed Dec. 22, 2008, which is a continuation-in-part of U.S. patent application Ser. No. 12/151,174, filed May 5, 2008, which application claims priority from U.S. Provisional Patent Application Ser. No. 61/062,724, filed Jan. 29, 2008; the disclosures of which are incorporated herein by reference.

BACKGROUND OF THE INVENTION

1. Technical Field

The invention relates to vacuum cleaning systems, and in particular to a storage system connected to a vacuum source for storing an extendable length of hose in a retracted condition within a storage housing. More particularly, the invention relates to a small, compact storage system adapted to be mounted in a concealed area within a home, such as in a kitchen cabinet, which contains a sufficient length of an expandable hose for ease of cleanup of the adjacent room.

2. Background Information

Central vacuum systems for home and commercial use have, been used for many years, examples of which are shown in U.S. Pat. Nos. 2,943,698 and 3,173,164. These systems usually are comprised of a main vacuum source which is usually mounted in the basement or other location in the structure or closely adjacent thereto. The vacuum source is connected to various outlet locations in the structure by tubing which terminate in valves mounted in the wall into which one end of a length of cleaning hose is removably connected for cleaning an area adjacent the wall valve. These wall or hose end valves usually include some type of closure lid, which seals the hose receiving opening in the valve enabling another of the valves to be operational within the structure. Many of these valves are provided with electrical contacts or switches which energize the main vacuum source. The vacuum hose also may be provided with a pair of electric conductors for actuating the central vacuum source by a switch on the handle, such as shown in U.S. Pat. Nos. 4,064,355, 4,133,972, 4,194,081 and 4,368,348.

When using the cleaning system, the homeowner will generally have a single length of cleaning hose with various attachments which are stored in a closet or other location requiring the hose to be moved from room to room to be connected to the appropriate wall valve for cleaning the area adjacent the valve location. In many situations, this is less convenient than desired since the homeowner must continually go to a remote location to retrieve the cleaning attachments and hose for use in a particular room and then return the cleaning attachment, cleaning wand and hose to the closet for final storage. Also, these storage areas become cluttered and occupy needed space in other closets of the house.

Some central vacuum cleaning systems attempt to solve some of these storage problems by having the hose retractably inserted into the vacuum supply duct when not in use such as shown in U.S. Pat. Nos. 2,953,806, 3,593,363, 5,526,842 and 7,010,829. In another attempt to solve this storage problem in a central cleaning system, an in-wall storage cabinet was developed and shown in U.S. Pat. No. 5,740,581. However, the storage arrangement of this latter system requires the use of a power-driven mechanism for retracting the hose when not in use. Although this may perform satisfactory for its intended purpose, it is a more costly installation than may be desired by many homeowners and it requires the hose to be dedicated to a single vacuum source. This prevents the same vacuum source to be energized for supplying a vacuum to other wall valves in the structure. Also, these units may tend to be weak because their size is very limited, and in addition, their dirt capacity may also be limited.

Due to the need to retrieve the vacuum hose from a storage area and connected to an in-wall vacuum supply valve, many homeowners will not use the system for small cleanups, such as small quantities of dirt or other debris such as spillages in a kitchen or the like, and will use a manual broom. These types of cleanups usually are required in a kitchen, workroom or laundry area, but do not receive the homeowner's immediate attention due to the need of retrieving the relative long length of hose from the storage area and connecting it to a central vacuum system. Afterwhich the hose has to be disconnected from the wall valve and returned to the storage area.

Thus, the need exists for an improved hose storage system contained in a small, compact hose storage housing which can be located inside of a larger storage cabinet, such as a kitchen sink cabinet or adjacent cabinet, which facilitates the use of the vacuum cleaning equipment in a relatively simple and convenient manner, and most importantly enables a sufficient length of cleaning hose to be easily removed from and returned to the storage housing when not in use, and which can enable other vacuum outlets in the structure to be active, that is, have the vacuum source supplied to the storage housing of the present invention and to other vacuum outlets from a single central vacuum supply source, by providing a closure for an open end of the cleaning hose when not is use and stored in the housing.

BRIEF SUMMARY OF THE INVENTION

The present invention provides a vacuum hose storage system having a compact hose storage housing for storing the cleaning hose, wherein the housing preferably is mounted in a larger storage area or cabinet which is connected to a vacuum source tube, which tube can extend from a main central vacuum source or from a self-contained vacuum source located within or adjacent the hose storage housing.

Another feature of the invention is to provide such a hose storage system in which the hose is permanently connected to a vacuum source tube by providing a sealing device at an open end of the hose handle which enables a central vacuum source to be active and provide a source of vacuum at other wall valves throughout the structure, enabling another hose to be used by the homeowner at one or more of these other valves if desired.

Still another feature of the invention is to provide such a hose storage system in which the hose when not in use is inserted into a pivotally mounted cradle which automatically actuates a switch to turn off the vacuum source and which seals the end of the hose to enable a central vacuum source to be active and provide a source of vacuum at other wall valves throughout the structure.

A further feature of the present invention is to provide the hose storage housing with a plurality of rollers attached in a spaced relationship between the walls of the housing within the storage compartment around which the hose is placed in a looped fashion preventing it from becoming tangled within the housing, and which enables the hose to be easily grasped and pulled from the housing by expanding the hose from a retracted to an extended position.

Another aspect of the invention is to form the rollers with a concave outer circumference to ensure that the hose during expansion and contraction remains in proper alignment within the storage housing thereby reducing friction during expansion and contraction of the hose.

Still another aspect of the present invention is to provide a sealing device for an open end of the hose handle when the handle is mounted in a storage cradle, which sealing device can have various configurations for sealing the open end of the handle while the vacuum supply is energized, and in which an ON/OFF switch can be mounted in the support cradle to turn the vacuum power supply ON and OFF automatically upon placing the handle in the cradle.

Another aspect is to provide the hose with an expansion ratio of 5 to 1 thereby enabling a long useable length of hose to be obtained from a relatively short contracted length of hose easily stored in a small storage area.

A further feature is to provide a vacuum storage system in which one or more drive belts may extend between the hose storage rollers to assist in the uniform expansion and contraction of the hose as it is pulled from or retracted back into the housing by synchronizing the rotational movement of the rollers.

Still another feature of the invention is to provide a small compact storage housing preferably mounted within an outer cabinet which stores a maximum length of hose in a minimum amount of storage space within the housing whereby the hose end is easily removed from a storage cradle which upon removal will automatically turn the vacuum source ON and when returned to cradle will automatically turn the vacuum source OFF, in which a maximum length of hose can be stored and removed from a minimum storage area, and in which the vacuum source can be connected at various locations in the storage housing and connected to a remotely located central vacuum source or to a dedicated source of vacuum adjacent the hose storage housing.

Another aspect is to use a neutrally biased hose or an expansion biased hose which relies upon the retraction force created by the vacuum to assist in retracting the hose back into the housing after use eliminating the use of a spring biased retraction type of hose.

Still another feature of the invention is to use a switched hose for actuating the vacuum source by providing an ON/OFF switch on the wand or handle which is connected to the vacuum source motor via electrical conductors extending through the hose.

A further feature is to provide a type of ratchet mechanism on the hose storage rollers which will lock the rollers in position upon pulling the hose from within the storage housing which relieves the biased retraction force on the hose avoiding the user having to continually apply a force to the hose when in use to prevent it from being pulled back into the housing.

A still further feature is to provide a high voltage source (120V or 240V) to a power driven brush-type of cleaning attachment mounted on the end of the hose and connected to the remote source of voltage by electrical conductors extending through the hose to enhance the cleaning ability of the vacuum cleaning system.

Another aspect of the invention is to provide a length of tubing fixedly mounted in the storage housing and extending in a serpentine fashion in which the length of expandable hose is located within the tubing and has an inner end which is slidably, sealingly engaged within the tubing to enable the length of hose to be pulled from its stored position within the tubing, which in combination with the natural expansion of the hose provides a considerably greater length of available hose from within the storage compartment.

Another feature of the invention is to provide a control knob located on a handle receiving cradle which receives the end of the hose, which when operated controls the size of an opening in the internal vacuum line to regulate the strength of vacuum applied to the cleaning end of the hose.

Still another aspect of the invention is to provide a stiff wire pivotally mounted on a front wall of the housing which has a curved configuration which can be manually moved into and out of engagement with a helical spring incorporated within the vacuum hose to provide a one-way latch preventing movement of the hose towards its retracted position within the housing, while permitting free pulling of the hose from the housing toward a desired extended position.

A further feature of the present invention is to provide a plurality of tool holder brackets secured to the housing with attachment thumb screws.

Another feature of the present invention is to provide side panels on the housing which may contain decorations or printed indicia which are removably secured within complementary-shaped recesses formed in side walls of the housing.

A further aspect of the present invention is to provide a U-shaped mounting bracket which is secured to the bottom wall of a storage cabinet or other mounting structure whereupon the housing can be snap-fitted therein to removably mount the housing on the storage bracket permitting easy removal for maintenance.

Still another feature of the present invention is to mold a plurality of stub shafts on opposed side walls of the housing to form roller shafts on which are rotatably mounted hose guide rollers within the internal storage compartment of the housing thereby reducing production costs by eliminating mounting separate shafts on the side walls for mounting the rollers thereon.

A still further aspect of the present invention is to form at least three holes in the spaced side walls of the housing, which holes receive standoff brackets formed on cardboard packing panels which space the housing from an outer packing box, which panels are then slidably received within the outer packing box to provide a gap or crush zone between the housing and the packing box preventing damage to the housing when shipped and stored.

Still another aspect of the invention is to provide various snap-fit grooves in the housing side walls enabling the housing side walls to be snap-fitted into and removed from the other portion of the housing enabling the internal mechanism of the housing to be readily accessible for servicing and maintenance procedures.

These features and advantages are obtained by the vacuum hose storage system of the present invention, the general nature of which may be stated as including a housing or cabinet forming an internal storage compartment; a plurality of guide wheels mounted within the storage compartment; a length of hose extendable between a retracted position in the storage compartment and an extended position extending from said storage compartment, wherein the hose has a first end adapted to be connected to a vacuum source and a second end, with the hose extending in a looped fashion about the guide wheels when in the retracted and extended positions; a handle attached to the second end of the hose; a cradle for holding the handle in a stored position; a switch for turning the vacuum source ON and OFF when the handle is placed in the cradle; and a biasing device connected to the hose exerting a retracting force on the hose when in an extended position.

These features and advantages are further obtained by the vacuum hose storage system of the present invention the general nature of which includes a housing forming an internal storage compartment; a length of tubing fixedly mounted within the storage compartment and arranged in a serpentine fashion with a first end adapted to be connected to a vacuum source and an open second end; a length of hose located within the tubing and movable within said tubing from a retracted collapsed stored position to an extended expanded position from said tubing and the storage compartment, the hose having a first seal adjacent a first end of the hose and movable with the hose in sealing engagement with the tubing, and an open second end for collecting dirt from an area to be cleaned, wherein the hose moves in a serpentine fashion throughout the tubing between the retracted stored position and the extended position; a handle on the second end of the hose; a cradle on the housing for holding the handle when the hose is in the retracted position; and a switch for turning the vacuum source ON and OFF.

These features and advantages are further obtained by the vacuum hose storage system of the present invention comprising a housing forming an internal storage compartment; a length of hose extendable from a retracted position in the storage compartment to an extended position extending from said storage compartment, wherein the hose has a first end adapted to be connected to a vacuum source and an open second end for collecting dirt from an area to be cleaned; a handle on the second end of the hose; a cradle on the housing for holding the handle when the hose is in the retracted position; a control valve on the cradle for regulating the strength of the vacuum source; and a switch for turning the vacuum source ON and OFF.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
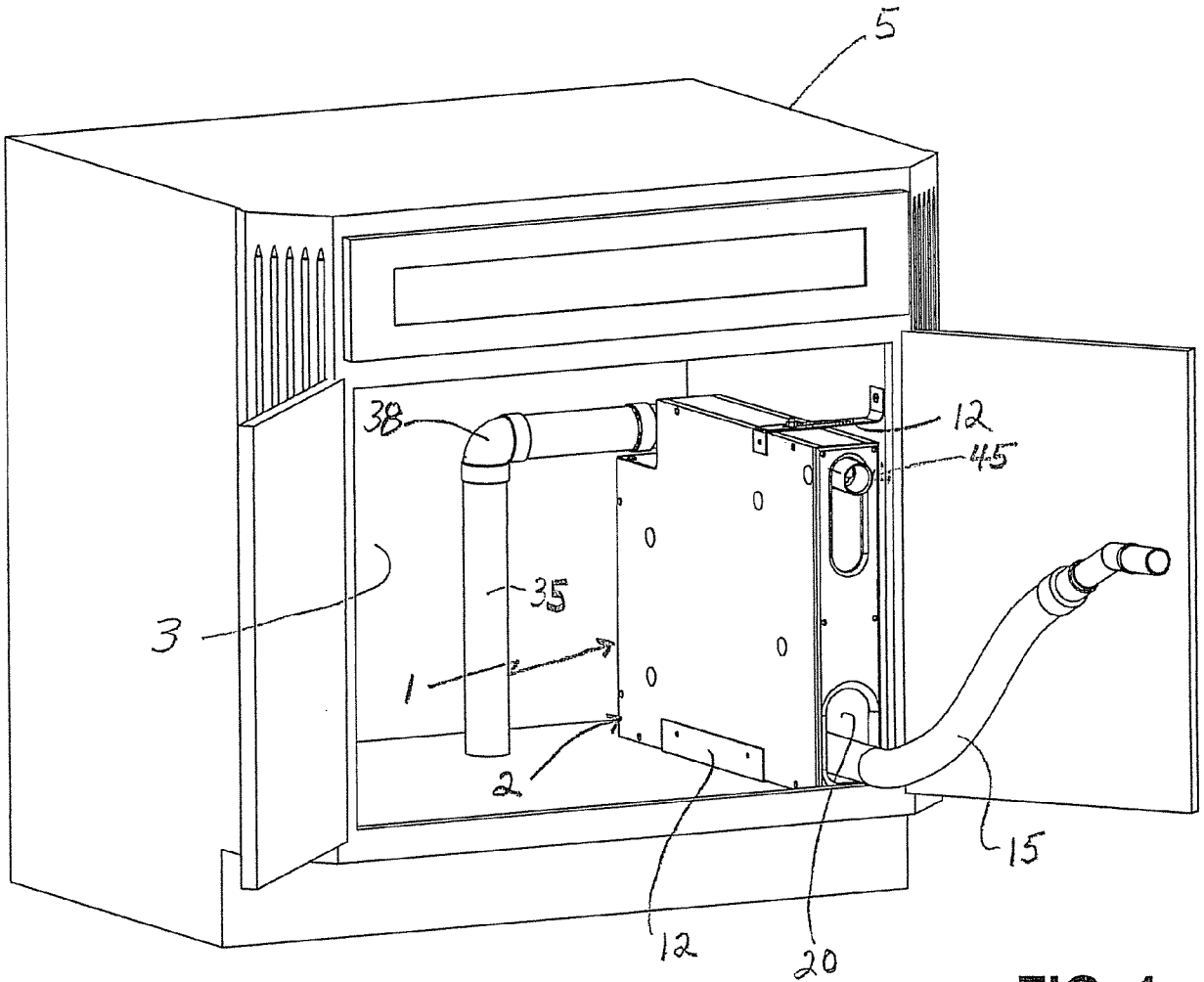
FIG. 1 is a diagrammatic perspective view showing the vacuum hose storage system mounted within an outer storage cabinet and the hose in a partially extended position.

The improved hose storage system of the present invention is indicated generally at 1, and includes a storage housing 2 which is shown in FIG. 1 mounted within the interior 3 of a larger cabinet 5. Storage cabinet 5 preferably is of the type found in most kitchens, laundry rooms or work rooms. Hose storage system 1 is shown removed from cabinet 5 in FIG. 2. Housing 2 preferably has a parallelepiped configuration with opposed side walls 7, opposed top and bottom walls 9 and opposed back wall 10 and front wall 11 which form a hollow interior storage compartment 13 (FIG. 3). In the preferred embodiment, housing 2 will have a length between back and front walls 10 and 11 of twenty and one half inches, a height between top and bottom walls 9 of seventeen inches, and a thickness between side walls 7 of three and one quarter inches, providing a compact structure easily accommodated within the interior of various types of outer cabinets 5. One or more brackets 12 may be used to secure housing 2 within outer cabinet 5 as shown in FIG. 1.

Figure 6:
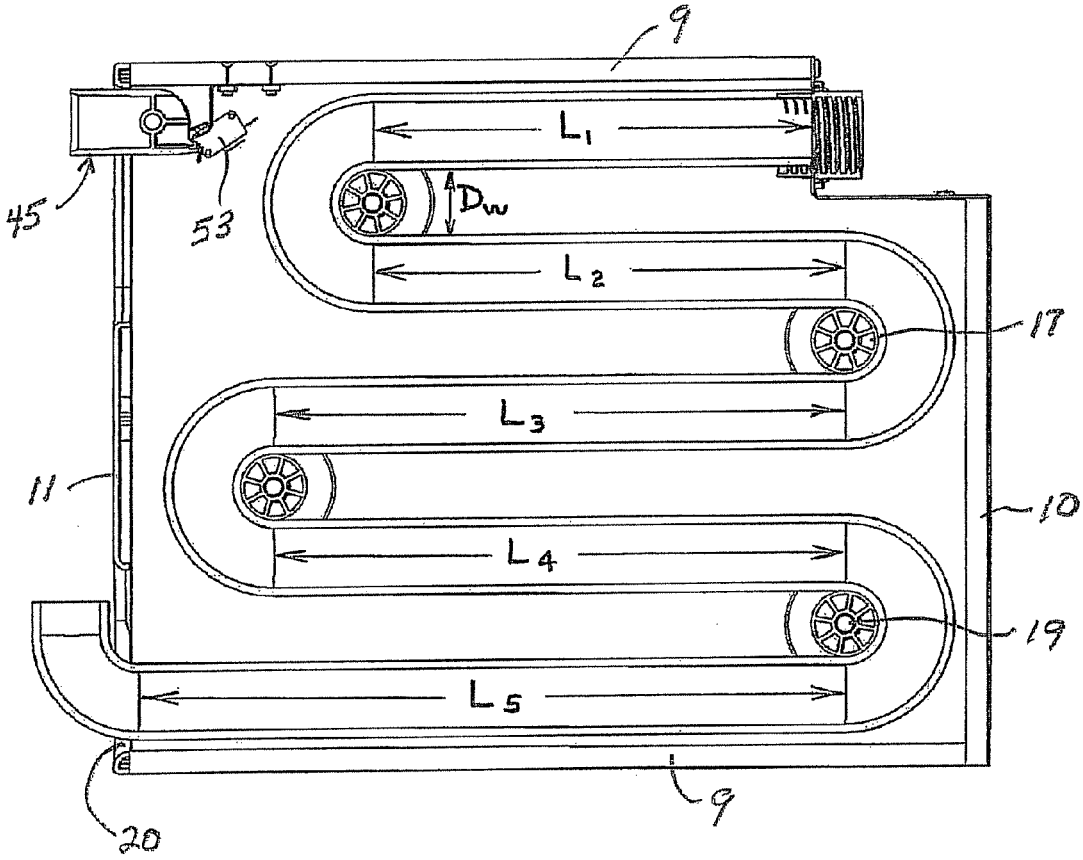
FIG. 6 is a fragmentary side view showing the hose in a fully retracted stored position within the storage housing.
Figure 8:
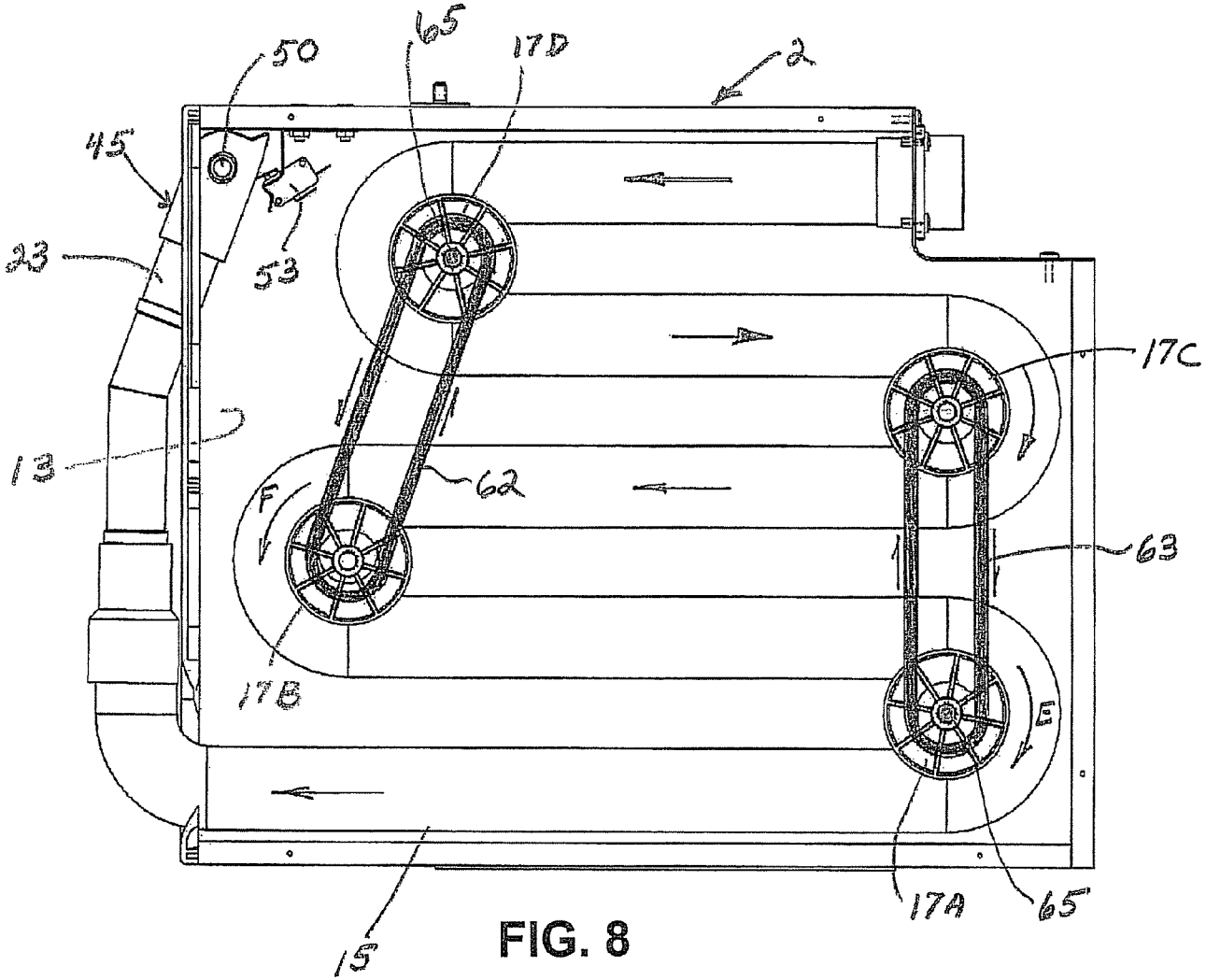
FIG. 8 is a side elevational view with the side wall of the housing removed showing a modified embodiment wherein a pair of drive belts assist in extending and retracting the hose into and out of the housing.
Figure 12:
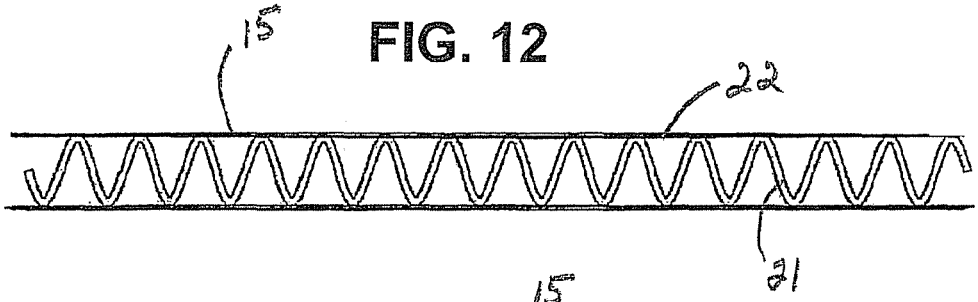
FIG. 12 is a diagrammatic cut-away view of the hose of FIG. 13 in an expanded position.
Figure 13:
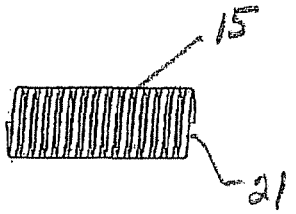
FIG. 13 is a diagrammatic perspective view of a portion of the hose of FIG. 12 in a collapsed position.

In accordance with one of the features of the invention, an extendable hose 15 is mounted in a looped fashion about a plurality of guide rollers 17 which are rotatably mounted within housing 2 on shafts 19, which preferably extend between and are mounted on spaced side walls 7. In the preferred embodiment shown in FIG. 3, four rollers 17 are provided which form for five loops in hose 15. Hose 15 preferably is a type of expandable hose as shown in FIGS. 12 and 13 which includes an internal helical spring 21 which is encased in the outer layer of material 22. Hose 15 is pulled outwardly from housing 2 through a front wall opening 20 and extends from a collapsed position as shown in FIGS. 6 and 8 to a stretched or expanded position of FIG. 3. This will tension spring 21 which then biases the hose towards the collapsed or retracted position of FIGS. 2 and 6 when the outward pulling force exerted thereon is released. The looped arrangement of hose 15 about rollers 17 as shown in FIGS. 3 and 6, enables a relatively large length of hose 15 to be stored within compartment 13 without becoming entangled while providing a sufficient length of hose when pulled therefrom as shown in FIG. 3 to perform cleanup throughout a room in which cabinet 5 is located. The preferred hose 15 will have an elongated factor of 5, that is, if the hose has a collapsed length of eight feet and it has an extended length of forty feet. If desired, hose 15 can be a neutrally biased hose or an expansion biased hose, which types rely solely on the vacuum source to retract it back into the housing.

In the preferred embodiment, hose 15 in a collapsed position as shown in FIG. 6 will have a length of 8 feet, and when stretched out with a 5 to 1 ratio will have a length of approximately 40 feet. When in this fully stretched out position, approximately 8 feet will remain in storage compartment 13 about rollers 17 providing approximately 32 feet of hose extending from housing 2 for use in cleaning up an area about outer storage cabinet 5. However, these lengths can change without affecting the concept of the invention.

Figure 17:
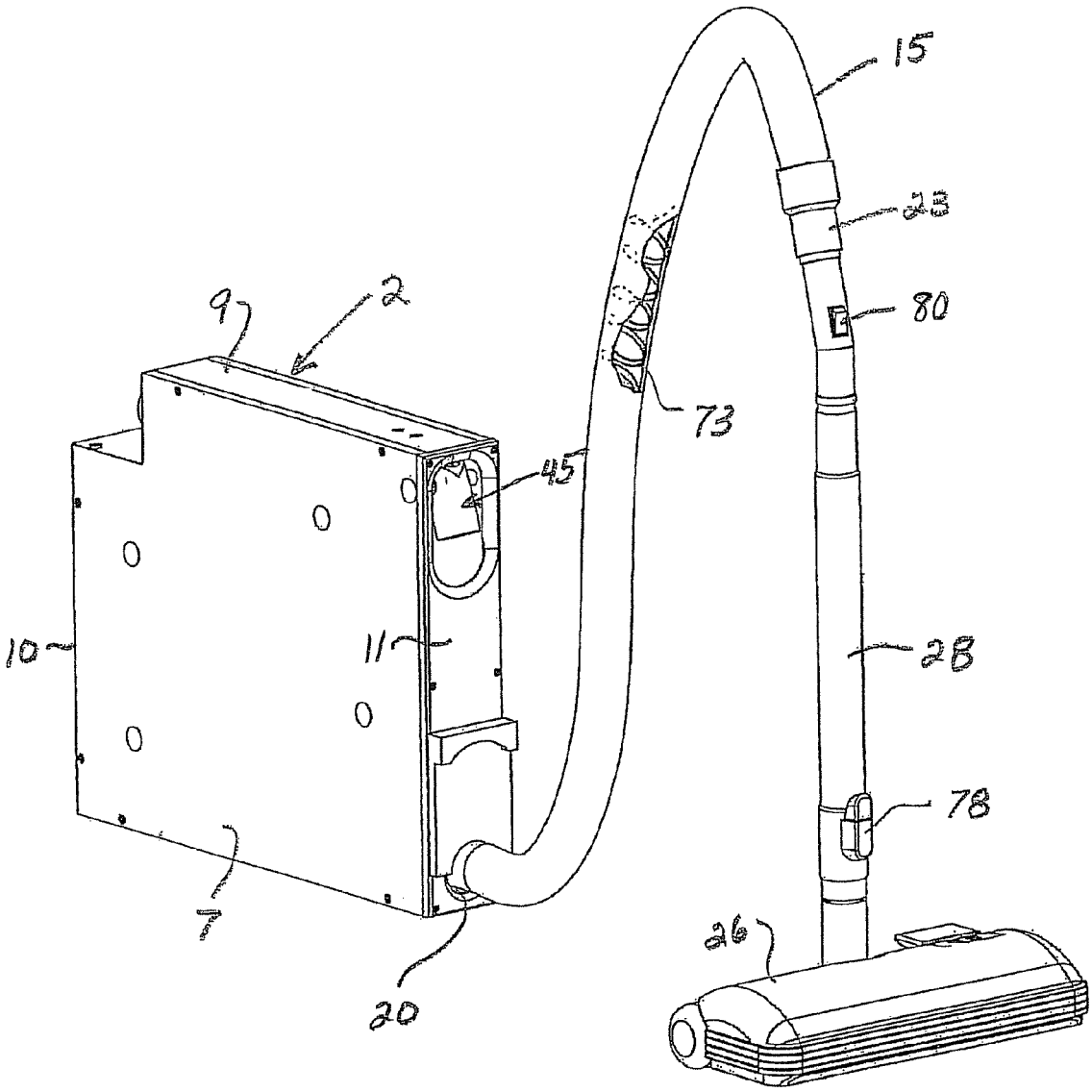
FIG. 17 is a perspective view of another embodiment of the hose storage system of the present invention.

A handle 23 is attached to the distal open end 25 of hose 15 by a connector 27 (FIG. 3). Handle 23 is a rigid tubular member formed of plastic or metal and will have an open end 29 through which dirt enters the hose interior. If desired, a cleaning attachment such as a rotary power driven brush 26 as shown in FIG. 17 could be attached to a wand 28 which in turn is attached to the open end of handle 23. However, for many of the types of cleanups for which hose 15 is intended to be used, a separate attachment is generally not required.

Figure 7:
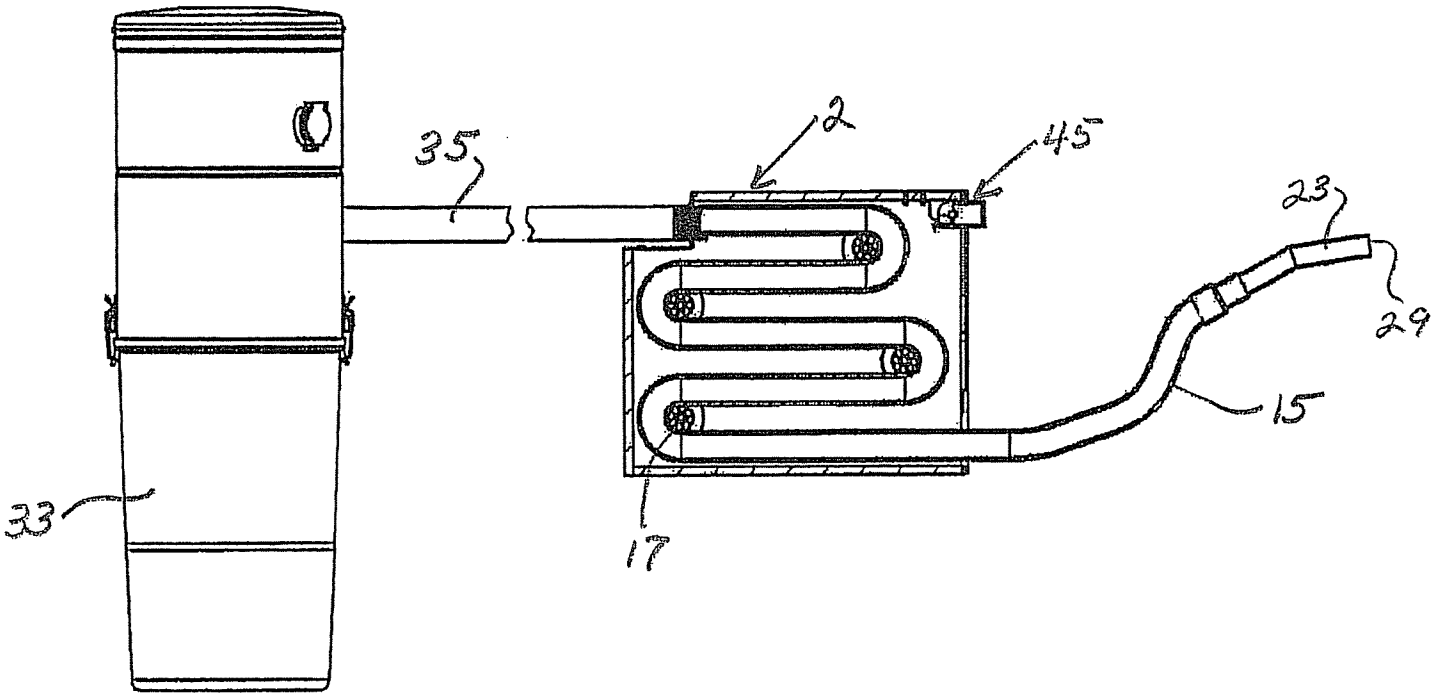
FIG. 7 is a diagrammatic view of the hose storage housing shown in section and the hose in a partially extended position connected to a remote central vacuum cleaning unit.

A vacuum source such as a central vacuum cleaning unit 33, as shown in FIG. 7, generally is mounted in a basement, attic etc. of the building, can be connected directly to housing 2 by a length of tubing 35 or with an elbow pipe 38 as shown in FIG. 1. A vacuum source such as a self-contained vacuum producing motor 32, can be mounted within a separate housing 31 (FIG. 15) that can be attached to a side wall 7 of housing 2 or mounted adjacent thereto and pneumatically connected to hose 15 by a section of tubing 30.

Figure 16:
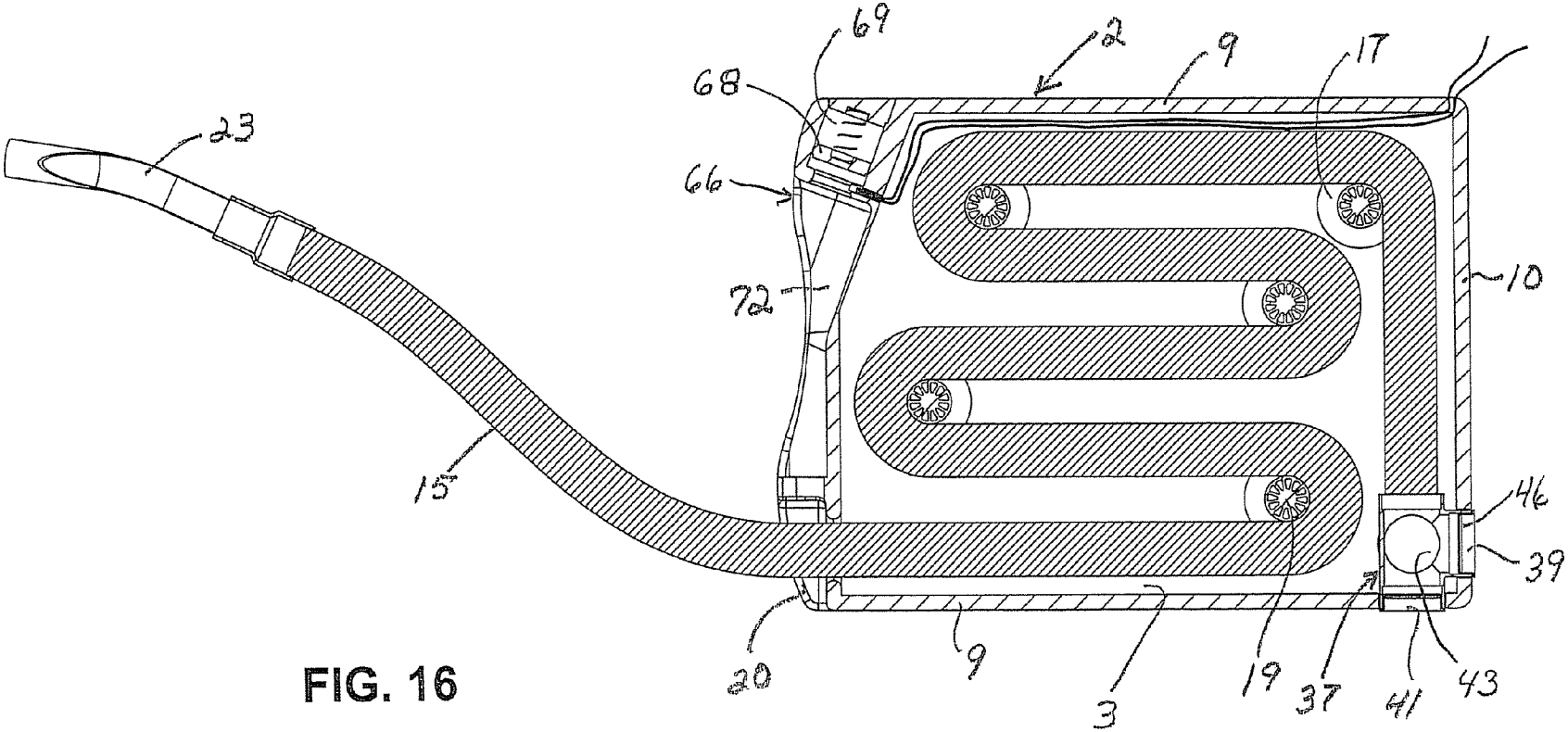
FIG. 16 is a diagrammatic cross-sectional view of a modified embodiment of the vacuum hose storage system of the present invention.

If desired, a special tube and hose connector 37 can be mounted in a lower rear corner of housing 2 (FIG. 16) and may have a plurality of outlets, such as outlet 39 in rear wall 10, a bottom outlet 41 in bottom wall 9 and a pair of opposed side wall outlets 43 formed in side walls 7. This provides other attachment locations for a section of tubing which is connected to the vacuum source depending upon the location of housing 2 within the larger outer storage cabinet 5, and the best location for the incoming vacuum supply tube. Any non-used tubing outlets as shown in FIG. 16 can easily be sealed by a cup-shaped seal 46 when not in use.

Figure 2:
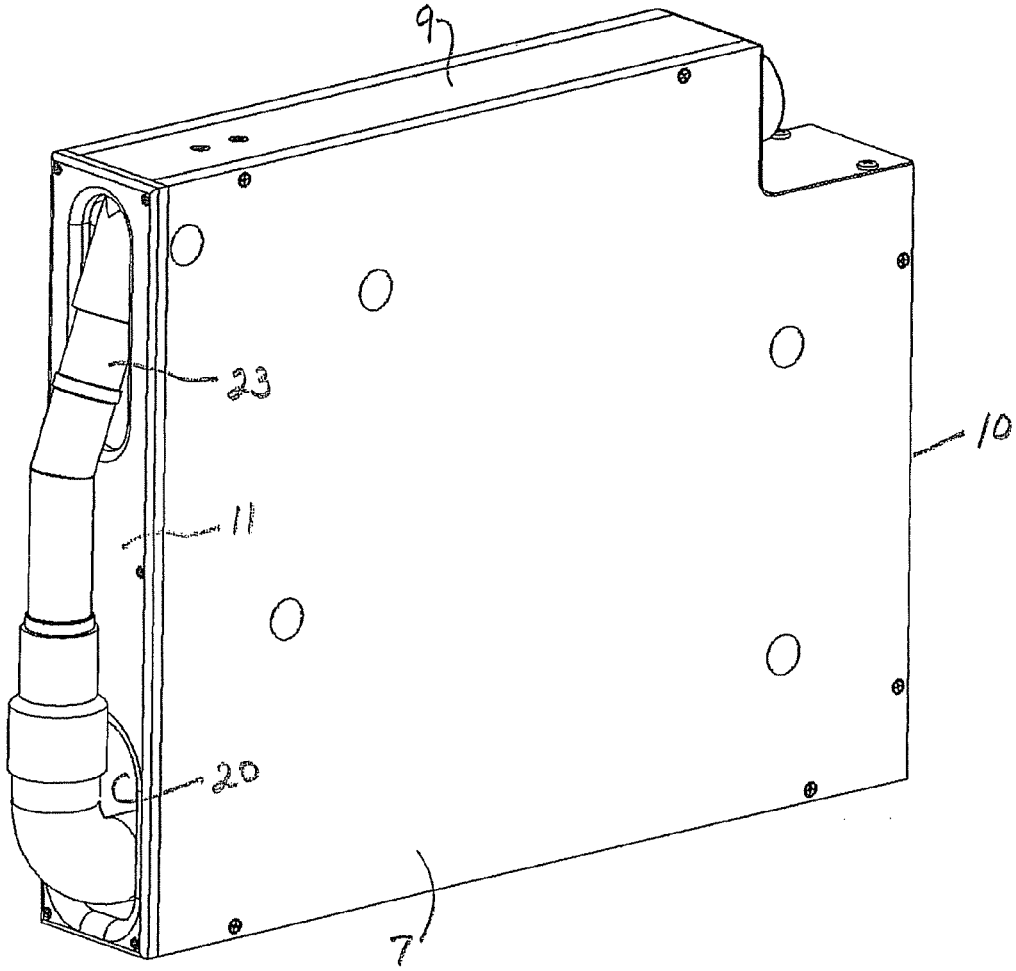
FIG. 2 is a side perspective view of the hose storage housing with the hose in a retracted position within the housing and the handle placed in the cradle.
Figure 3:
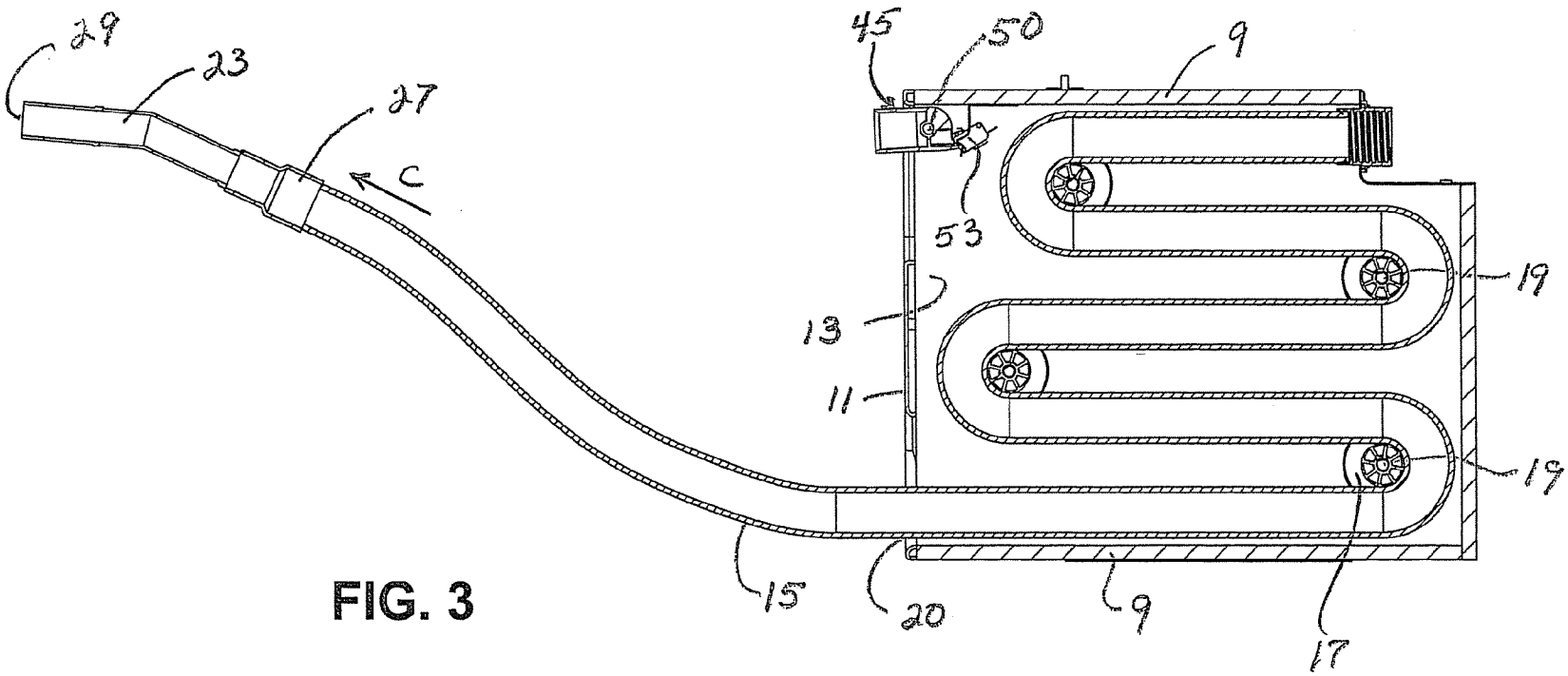
FIG. 3 is a diagrammatic side sectional view of the storage housing as shown in FIG. 2 with the hose in an extended position and the handle removed from the supporting cradle.
Figure 4:
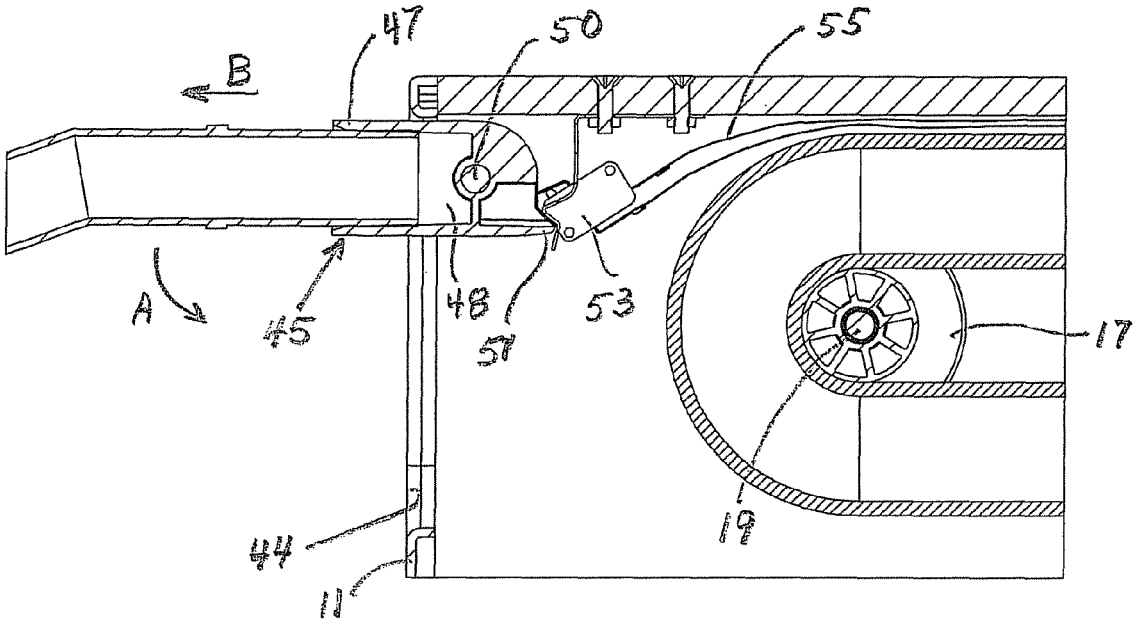
FIG. 4 is a fragmentary sectional view showing the hose placed in the supporting cradle in the power ON position.
Figure 5:
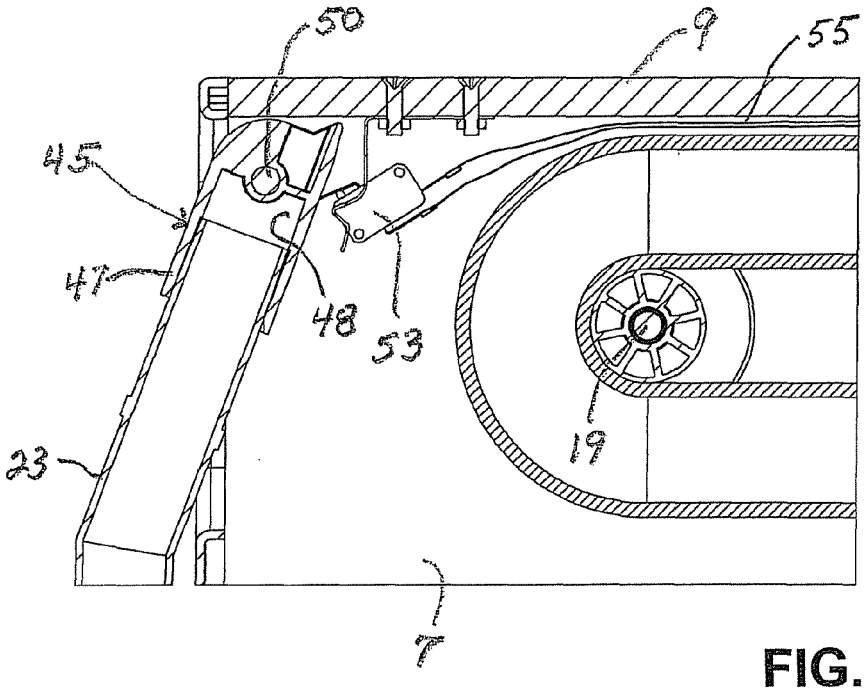
FIG. 5 is a fragmentary sectional view similar to FIG. 4 showing the hose supporting cradle in a power unit OFF condition.

In accordance with another feature of the invention, a hose receiving cradle 45 is located in front wall 11 of housing 2 and accessible through an opening 44 formed in front wall 11 (FIGS. 1 and 2). Cradle 45 includes a short section of tube 47 having a hollow interior 48 and is pivotally mounted by a pivot 50 between side walls 7 and is adapted to slidably receive handle 23 therein in a generally sliding frictional fit when the hose is not in use as shown in FIGS. 2 and 4. After insertion of the open end of handle 23 therein, the handle is pivoted downwardly as shown by Arrow A (FIG. 4) into the final stored position of FIG. 5. The inner end of cradle 45 is formed with a projection 51 which engages and actuates an ON/OFF switch 53 which is mounted closely adjacent thereto. This movement of cradle 45 from the ON position of FIG. 4 to the OFF position of FIG. 5 will turn the switch off. Switch 53 is connected to the vacuum power source by a plurality of electrical conductors 55. When handle 23 is in the storage position as shown in FIGS. 2 and 5, the switch is in the OFF position and when the user desires to use the vacuum system for a quick cleanup job, the user will merely grasp handle 23 and pivot it upwardly from the OFF position of FIG. 5 to the ON position of FIG. 4. This movement will automatically turn the vacuum source on, afterwhich the user merely slides the handle outwardly from the cradle as shown by Arrow B and then will pull outwardly on the hose in the direction of Arrow C, FIG. 3. This will start the hose to expand from its coiled condition to an expanded condition, as well as unwrapping it from around rollers 17.

Upon completion of a cleaning operation, the user will merely relax the pulling force on the hose wherein the expanded internal helical spring 21 of the hose will bias the hose toward a retracted coiled looped position around rollers 17 until the handle 23 is replaced into cradle 45 in the position as shown in FIG. 4. The handle is then pivoted downwardly to the full storage position of FIG. 5 which will automatically shutoff the vacuum source by actuation of switch 53. Also, retraction of the hose back into the housing is assisted by the force of the vacuum exerted on the hose which also biases the hose towards a retracted position. However, neither of the biasing force exerted on the hose by helical spring 21 or the vacuum source, is sufficiently great to require a large force to be exerted on the hose by the user to move it from the collapsed retracted position to its extended position and to maintain it in the extended position during a cleaning operation. However, this biasing force does assist in retracting the hose into its coiled looped position after cleanup has been accomplished. Also, storage system 1 can use a neutrally or expansion biased hose if desired, which relies solely on the vacuum source for retraction of the hose back into the housing.

FIG. 8 shows a slightly modified form of the present invention in which one or more drive belts 62 and 63 may extend around adjacent pairs of rollers 17 to assist in the extension and retraction of the hose from and back into the housing.

Upon initially pulling the hose from housing 2 in the direction of Arrow D (FIG. 8), the hose will immediately start to move about and rotate the lowermost roller 17A as shown by Arrow E. The next roller 17B begins to rotate shortly thereafter as the hose is stretched and starts to move about roller 17B as shown by Arrow F. This progresses to the next roller 17C and then to roller 17D in a slight time delay progression. By the use of drive belts 62 and 63, the initial rotation of roller 17A will automatically start roller 17C rotating almost simultaneously with the rotation of roller 17A. Likewise roller 17D will begin to rotate almost simultaneously upon the rotation of roller 17B due to its connection therewith by drive belt 62. The use of drive belts 62 and 63 will assist in starting movement of all of the sections of hose and their corresponding rollers almost at the same time to greatly facilitate the removal of the hose from within housing 2 instead of the delayed sequence which occurs as the hose is pulled from the housing without connecting belts 62 and 63. Likewise, upon the hose beginning to retract back into the housing without the use of the belts, roller 17A will begin to rotate followed shortly by the rotation of 17B, then roller 17C and finally roller 17D in a time delay sequence. The use of drive belts 62 and 63 will again enable the sections of hose and associated rollers to move more in unison assisting the retraction of the hose back into housing 2.

In accordance with another feature of the invention, one or more ratchet mechanisms 65 can be mounted on one or more of the rollers which when the hose is pulled from within housing 2 will prevent the rollers from having a tendency to rotate backwards since they are retained in their forward rotated position by the ratchet mechanism. This assists in reducing the biasing retraction force exerted on the hose by internal helical spring 21 and the internal vacuum. This reduces the fatigue on the user by not requiring the user to continually exert an outward force on the hose to prevent its retraction back into housing 2. The ratchet mechanism can be easily reduced by suddenly pulling out on the hose and then releasing this pulling force permitting the one or more rollers on which the ratchet mechanism are connected to rotate freely in the reverse direction. This type of ratchet mechanisms is well-known in the art such as used for vehicle seat belts and similar applications, and thus the details thereof are not described in further detail.

Figure 14:
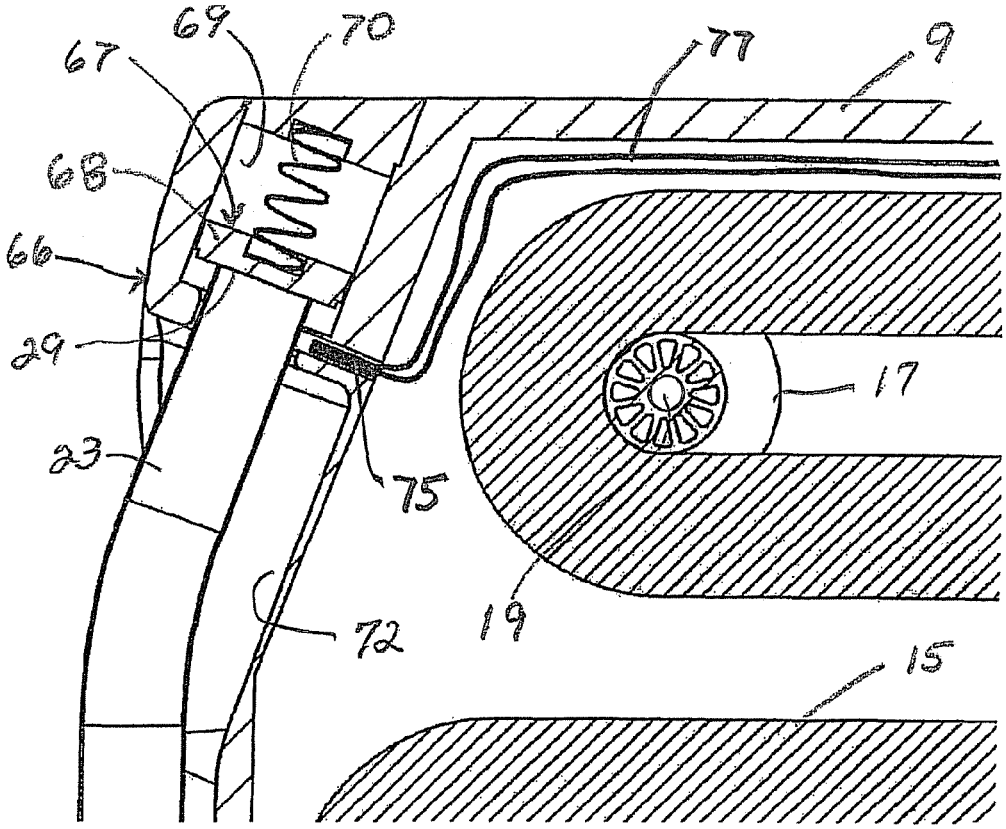
FIG. 14 is an enlarged fragmentary view showing the hose end in a stored position with a modified end sealing member engaged therewith.

A modified cradle 66 is shown in FIGS. 14 and 16 and includes a shutoff valve indicated generally at 67. Shutoff valve 67 is mounted in a compartment 69 formed at the corner of front wall 11 and top wall 9 for storing handle 23 in a readily accessible position. Shutoff valve 67 includes a sealing plate 68 which is biased by a compression spring 70 toward open end 29 of handle 23 for automatically sealing open end 29 upon insertion of the handle end through a front wall opening 72. Sealing plate 68 preferably will be used when the vacuum producing source is the central vacuum cleaning unit 33 as shown in FIG. 7, which is connected to other outlets throughout the building. This enables unit 33 to be operative for use throughout the structure.

Figure 15:
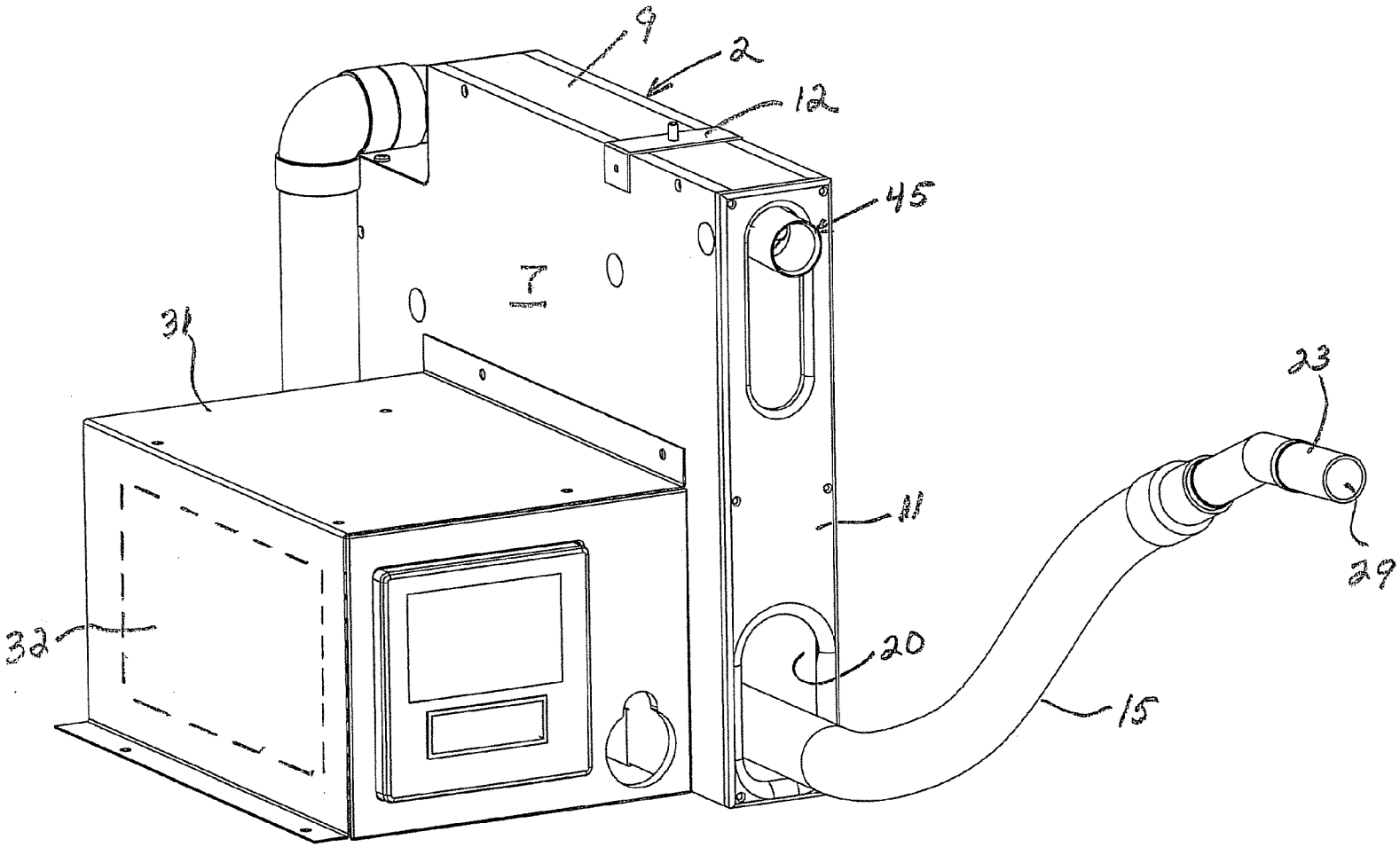
FIG. 15 is a perspective view of a vacuum power source mounted adjacent the storage housing of the type shown in FIG. 2.

An electrical ON/OFF switch 75 is mounted within or adjacent compartment 69 and connected to a source of electrical power by a pair of electrical conductors 77 for controlling a vacuum producing motor 32 such as shown in FIG. 15 or the motor of the central unit 33 as shown in FIG. 7. Switch 75 could be a plunger-type switch that is actuated automatically upon insertion of the end of handle 23 into compartment 69 or other type of switch without affecting the concept of the present invention. Likewise, sealing plate 68 can have other configuration than the spring biased seal as shown in the drawings and described above.

In accordance with another feature of the present invention discussed above is the attachment of a power driven rotary brush cleaning attachment 26 (FIG. 17) on the end of handle 23 by a wand 28 and connected to a remote source of high voltage electric power such as 120V/240V, by electrical conductors 73 which extend throughout the interior of cleaning hose 15. An ON/OFF switch 80 mounted on the wand 28 is used to control the operation of cleaning attachment 26. The cleaning attachment can be easily removed from the wand 28 by a connection clip 78 of the type well-known in the cleaning appliance industry. The cleaning wand 28 can then be easily detached from handle 23 after the cleaning operation has been completed.

In operation, housing 2 preferably is mounted within various types of an outer larger storage cabinet 5 or could be located in a closet or similar area and connected to a vacuum source, either an adjacent self-contained vacuum unit contains motor 32 (FIG. 15) or a remote central vacuum cleaning unit 33 (FIG. 7). Housing 2 can be placed vertically as shown in the drawings or horizontally without affecting its operation. The cleaning hose is operational immediately upon removing handle 23 from the cradle by automatically actuating switch 53 (FIG. 4) upon its upward pivotal movement or by actuating switch 75 (FIG. 14). Either type of vacuum unit will automatically turn on enabling the user to easily pull outwardly on the handle hose which will extend the hose from its collapsed position as shown in FIGS. 6 and 8 to an extended position as shown in FIGS. 3 and 7 as it unwinds about the spaced rollers 17. The user then pulls the hose to the needed length to reach the cleanup area and perform the desired cleanup. After the cleanup has been completed, the user merely releases the pulling force on the hose enabling internal spring 21 of hose 15 and the vacuum force to retract the hose into storage compartment 13 where it continues to collapse about the spaced rollers 17. As discussed above, the vacuum source created in the interior of the hose will also exert a retracting force on the hose, which in combination with the force exerted by spring 21, will permit the hose to be easily retracted automatically into storage compartment 13 about rollers 17. The user then inserts the end of the handle 23 into interior 48 of tube section 47 or into compartment 69 where open end 29 is automatically sealed by sealing plate 68, with switches 53 or 75 automatically being moved to the OFF position de-energizing self-contained motor 32 or remote vacuum unit 33.

The relatively small compact size of housing 2 and its ability to hold a considerable length of hose 15 and its automatic mode of operation will enable the user to easily remove the hose from its position within cradles 49 and 66 for cleaning up small spills or other dirt and debris in an adjacent area which heretofore required the homeowner to remove a length of hose from a storage area and connect it to an adjacent vacuum outlet valve. Heretofore, after picking up the dirt the user had to remove the hose from the wall mounted control valve and return it to its storage area. The collected dirt is drawn through hose 15 and deposited in a dirt receptacle contained in housing 31 (FIG. 7) or in the collection receptacle of central unit 33 (FIG. 7). It is also understood that housing 2 could easily be mounted freestanding in a work area, for example, adjacent a power saw for cleaning up sawdust or the like, could be located within a cabinet in an RV, boat or other vehicle where space is limited. Regardless of its location and mounting arrangement, it is able to store a relatively long length of hose to reach a considerable distance from the cabinet when in operation.

Storage system 1 enables an occupant to quickly pickup small quantities of dirt, spillage etc. by easily removing handle 23 from its storage cradle and directing open end 29 against the area being cleaned. Afterwhich hose 15 retracts automatically into housing 2 upon releasing the pulling force on the hose.

Figure 9:
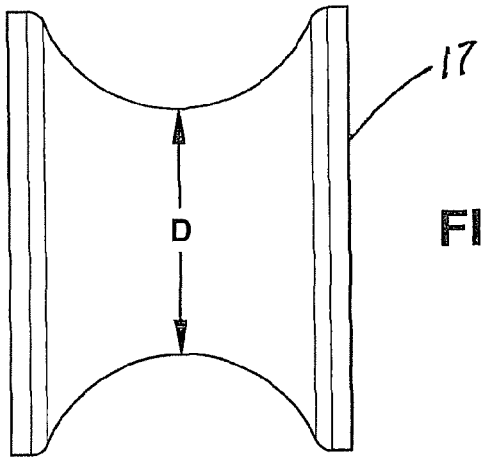
FIG. 9 is an elevational view of one of the guide rollers used for storing the hose within the housing.
Figure 10:
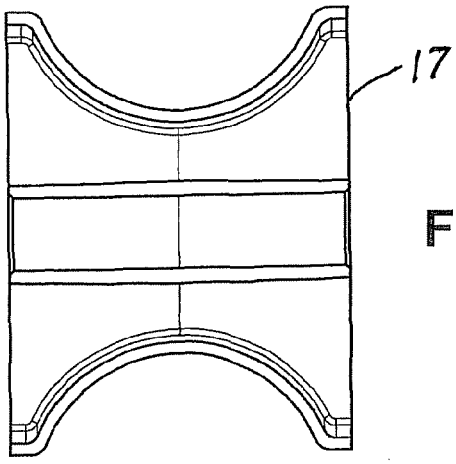
FIG. 10 is a sectional view through the center of the roller of FIG. 9.
Figure 11:
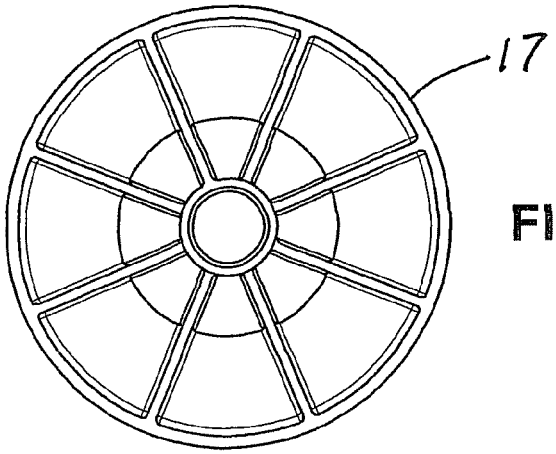
FIG. 11 is a side elevational view of the roller shown in FIG. 9.

In accordance with another feature, the total length of the hose for use in a particular size housing 2 can be determined easily by the following formula $L_{TOT}=\Sigma L+\frac{1}{2}W\pi D$ with reference to FIG. 6, wherein $L_{TOT}$ is the total length of the hose, $\Sigma L$ is the sum of the individual horizontal lengths between the center lines of the rollers indicated by $L_1$, $L_2$ etc., wherein W is the number of rollers, and D is the diameter of the rollers as shown in FIGS. 6 and 9.

Another embodiment of the hose storage system of the present invention is indicated generally at 100, and as shown in FIGS. 18-21. Hose storage system 100 is similar in most respects to hose storage system 1 described above and preferably includes the same housing as in system 1, including cradle 45, ON/OFF switch 53, shutoff valve 67 and sealing plate 68 as that of system 1, and thus is not described in greater detail.

The main feature of embodiment 100 is the mounting of a length of rigid tubing indicated generally at 102, within housing interior 3 in a serpentine arrangement. Tubing 102 is fixedly mounted in the housing, and in the preferred embodiment will include five horizontally extending straight sections 104 connected by U-shaped bends or corners 106. Tubing 102 can be mounted by various types of attachment brackets (not shown) to the interior of the walls of housing 2 and terminates in an open end 108 which is adapted to be connected to a vacuum source, such as central vacuum unit 33 or to an adjacent self-contained vacuum motor 32 as shown in FIG. 15. The opposite open end 110 of tubing 102 communicates with front wall opening 20 of housing 2. Tubing 102 can be formed of various materials with the preferred type being a rigid ABS plastic tubing having a 2 inch outer diameter and a 1⅞ inch internal diameter. However, it is readily understood that the number of horizontal sections 104 and U-shaped corners 106, as well as the type and size of tubing used, can vary without affecting the concept of the invention.

Figure 18:
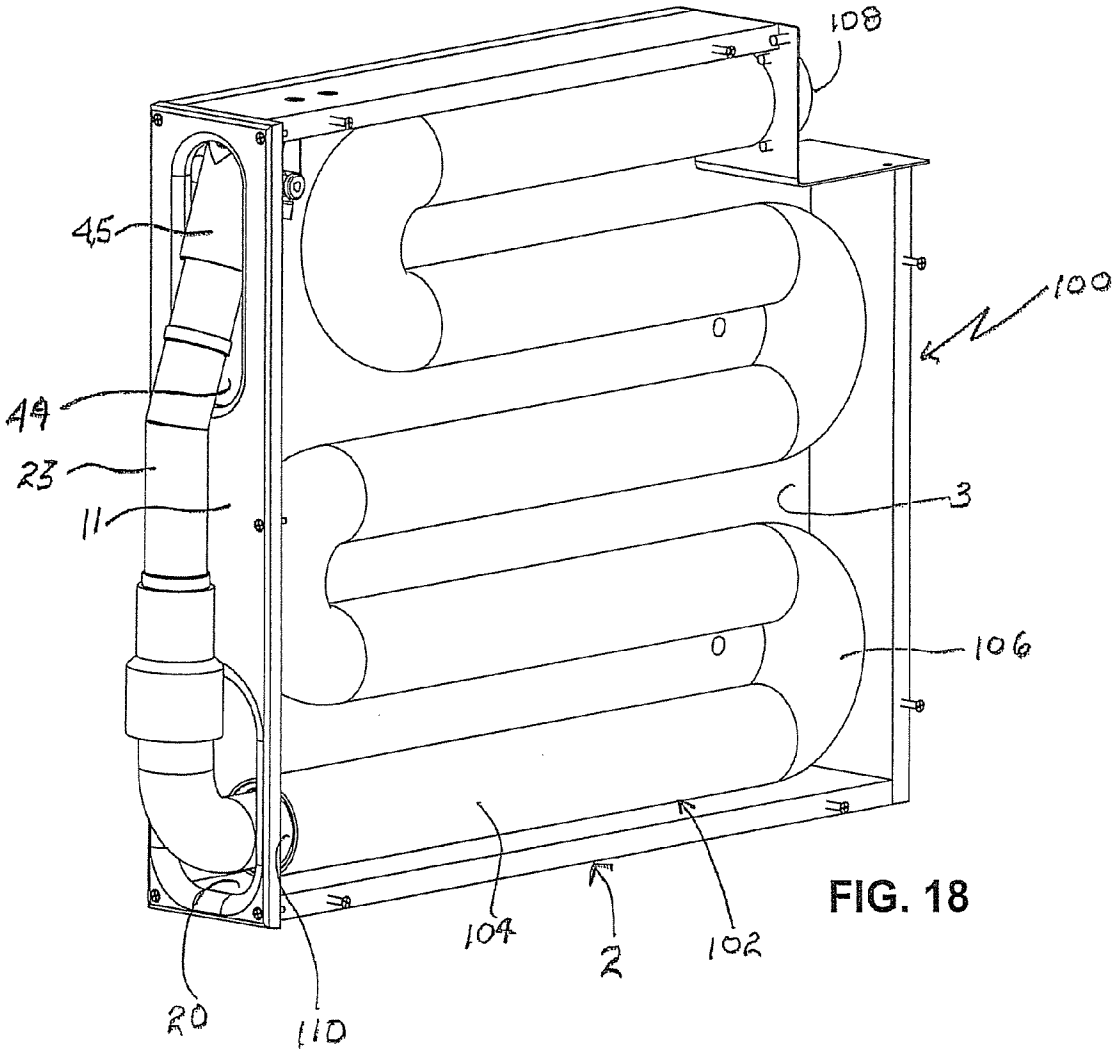
FIG. 18 is a diagrammatic perspective view of a modified vacuum hose storage system with the side wall removed and the hose in a retracted collapsed stored position.
Figure 19:
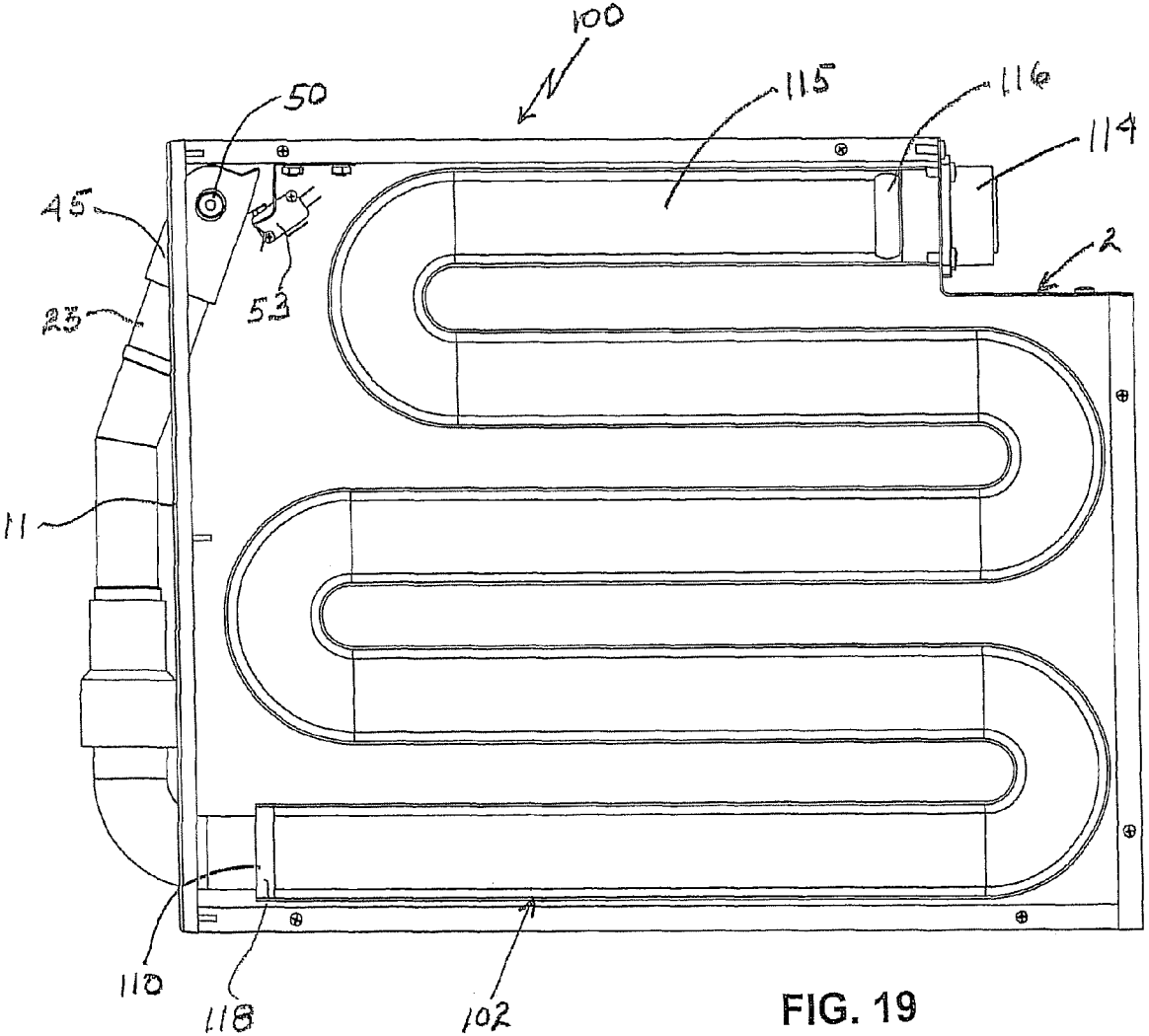
FIG. 19 is a side elevational view of the storage housing of FIG. 18.
Figure 20:
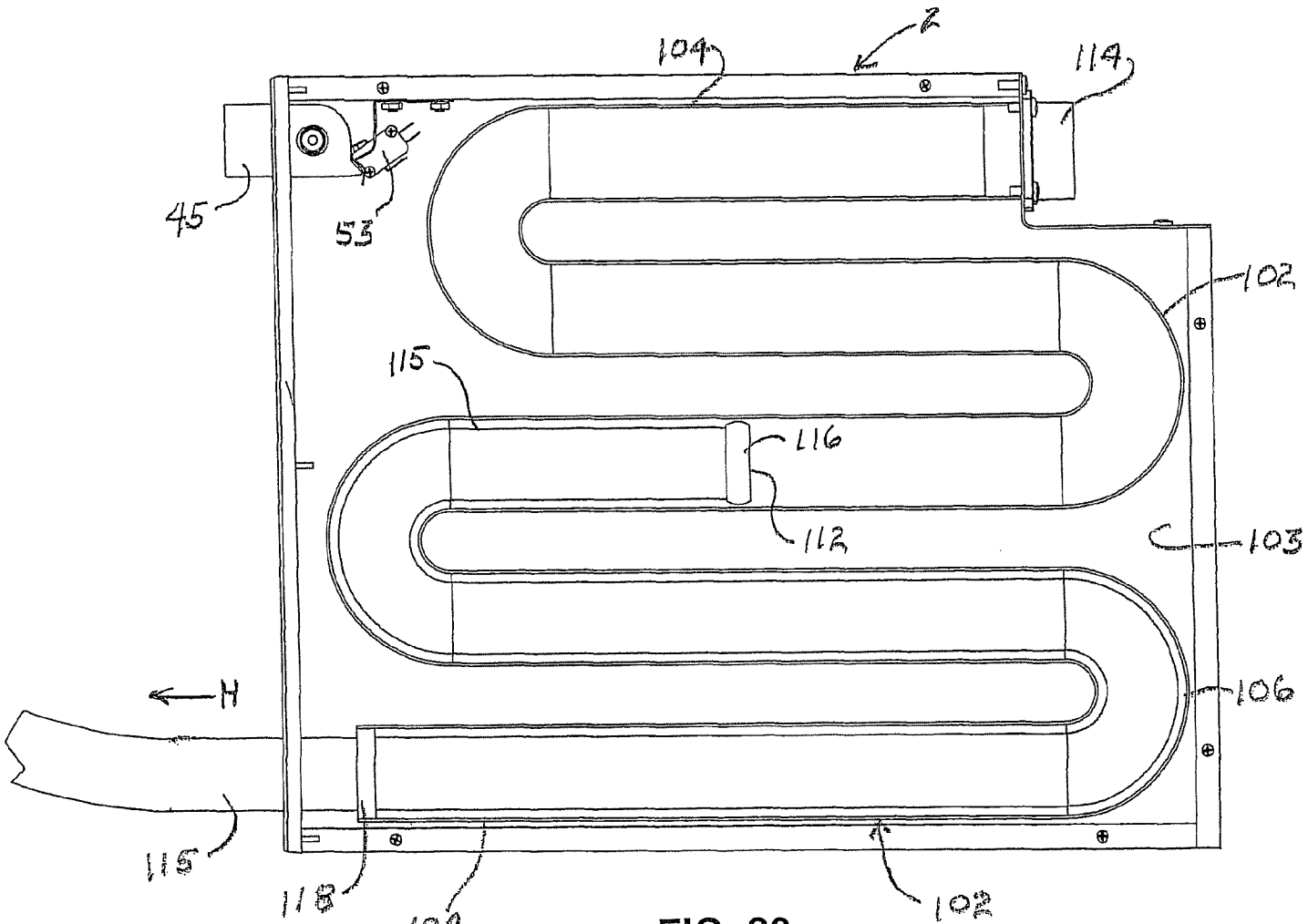
FIG. 20 is a side elevational view similar to FIG. 19 with the hose in a partially expanded and extended position.
Figure 21:
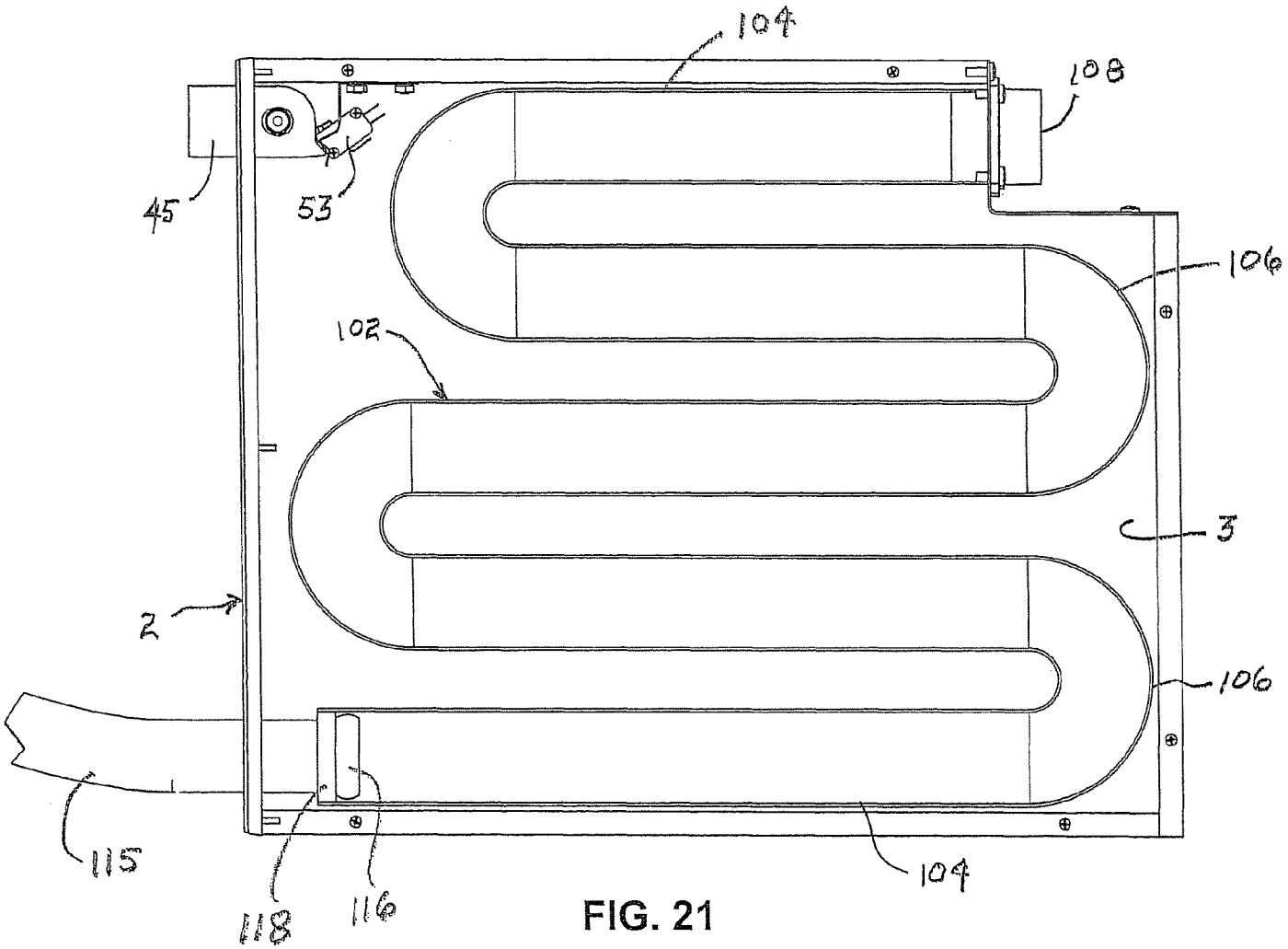
FIG. 21 is a view similar to FIGS. 19 and 20 with the hose in a fully extended position.
Figure 22:
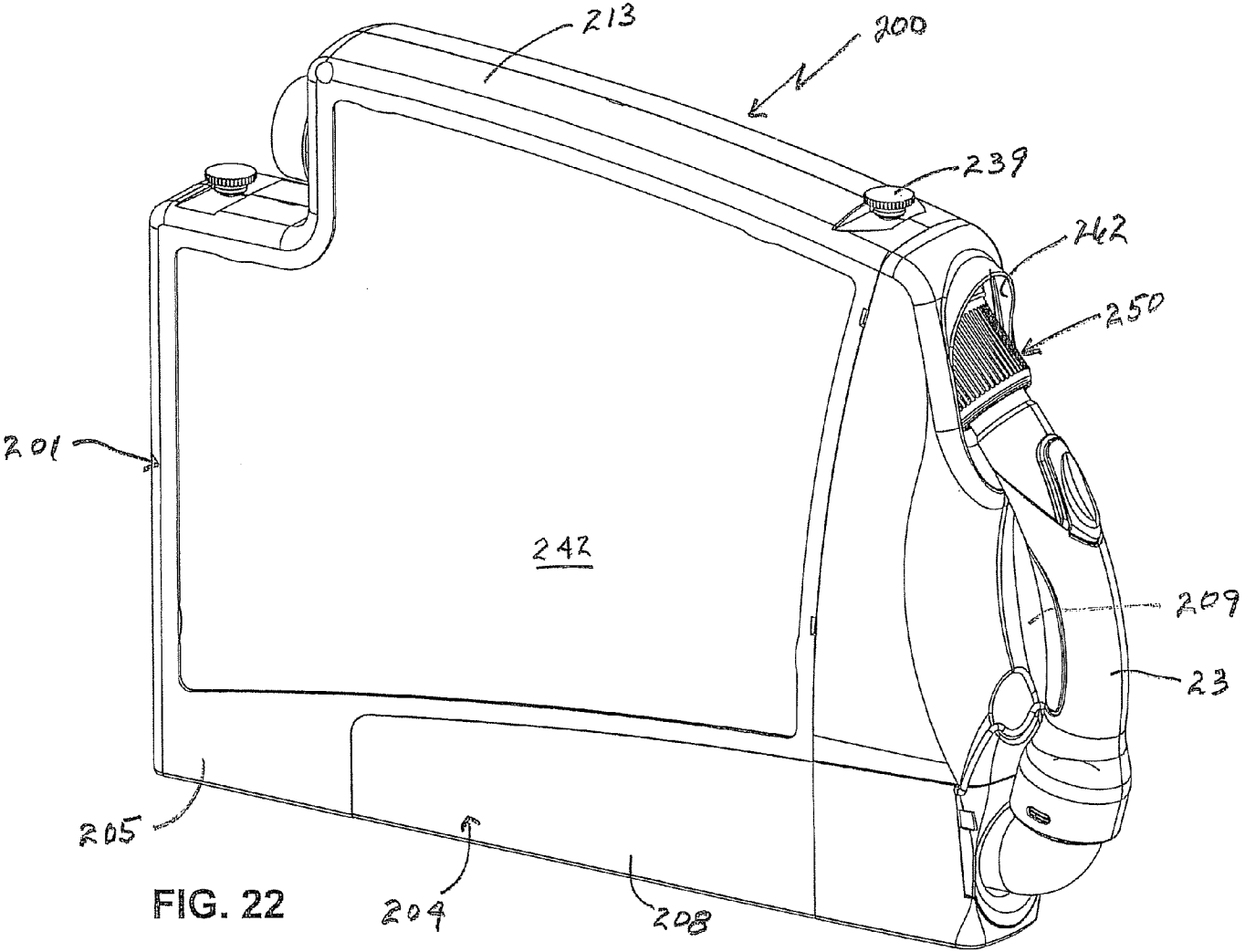
FIG. 22 is a diagrammatic side perspective view of a further modified vacuum hose storage system with the hose in a retracted stored position.

In further accordance with the invention, an expandable hose 115 is slidably moveably mounted within tubing 102 and is not rigidly attached at its inner end 112 to a coupler 114 as in system 1. An annular sliding seal 116 is attached to hose end 112 and is in a sliding, sealing engagement with the interior surface of tubing 102 so as to be slidably moveable therein from a fully retracted collapsed position as shown in FIG. 19 to a fully extended and expanded position as shown in FIG. 21. Seal 116 preferably is formed of a low friction material, such as Teflon®. Hose 115 is similar to hose 15 described above and preferably includes an internal helical spring 21, which exerts a biasing force for collapsing the hose towards its collapsed condition. FIGS. 18 and 19 show hose 115 in a fully collapsed retracted position within the storage housing with handle 23 being seated within pivotally mounted cradle 45 which actuates switch 53 and is sealed by sealing plate 68.

Upon an operator removing handle 23 from cradle 45, it will either automatically start the vacuum source being applied to the interior of the hose by actuation of switch 53 or by a switch mounted on the handle (not shown). The operator pulls outwardly on the hose in the direction of arrow H (FIG. 20) to expand hose 115, as well as causing sliding seal 116 to move within the interior of tubing 102, moving from the position of FIG. 19 to that of FIG. 20. Upon further force being applied to handle 23, hose 115 will expand further, as well as sliding seal 116 extending further within the interior of tubing 102 to a fully extended position as shown in FIG. 21, in which position sliding seal 116 will engage a stop 118 attached to the open end 110 of tubing 102. This enables a greater length of hose to store within housing 2 and be available to the user than the construction wherein the inner hose end is firmly connected to the vacuum inlet tube, as in the embodiments shown above in FIGS. 1-17. It also reduces the pulling force required by the user for extending the hose from within the storage compartment. Again, as in embodiment 1, the vacuum force being applied to the interior of the hose will apply a retraction force on the hose, especially when the open end of the handle is closed assisting the helical spring within the hose to pull the hose completely from its extended position as shown in FIG. 1 to its fully retracted position of FIG. 19, as well as collapsing the hose from its expanded condition of FIG. 21 to its collapsed position of FIG. 19.

Embodiment 100 provides a length of tubing which extends in a serpentine fashion within the housing and contains a length of expandable and slidably mounted hose in the tubing which, in combination with the natural expansion of the hose, provides a considerably greater length of available hose from the storage compartment without increasing the pulling force required to pull the hose from within the housing by providing the generally air-tight seal between sliding seal 116 and the interior of the rigid tubing 102. It is readily understood that the interior of tubing 102 is air-tight and that although there may be slight leakage of air around sliding seal 116, it is minimal so that it does not greatly affect the vacuum cleaning source applied to the interior of the hose by the vacuum cleaning motor. Hose 115 can be of the same type as hose 15 described above or could be a neutrally biased hose or other type of expandable hose which requires the mounting of sliding seal 116 on one end thereof and the handle 23 on the other end thereof, while providing the advantages of hose storage system 1 described above.

A still further embodiment of the present invention is indicated generally at 200, and is shown in FIGS. 22-35. Embodiment 200 includes a housing 201 having the general parallelepiped configuration as that discussed above for the other embodiments. It includes a pair of side walls 205 and 207, front and back walls 209 and 211 and top and bottom walls 213 and 215 respectively, which form an internal storage compartment 202 for storing a length of hose 15 on a plurality of guide rollers 17 as discussed above for the embodiment shown in FIGS. 1-17. Embodiment 200 has a number of additional features and modifications to enhance its usefulness and to facilitate the cleaning of a dedicated area.

One of the additional features is a U-shaped mounting bracket 204 (FIG. 32) which is adapted to be secured to the base of a cabinet, such as bracket 12 in the embodiment shown in FIG. 1. Bracket 204 has a generally U-shape with a pair of spaced side walls 206 and 208 with an intervening flange wall 217. Side walls 206 and 208 are each formed with an elongated projection 210 and smaller rear projections 212 which are snap-fitted in corresponding recesses formed in the exterior surface of the spaced side walls 205 and 207 of vacuum storage housing 201. The use of U-shaped bracket 204 enables housing 201 to be easily snap-fitted into and removed from a storage cabinet 5 without requiring the loosening and/or removal of threaded fasteners or other types of attachment devices. Bracket 204 preferably is formed of a plastic or metal sufficiently flexible to enable the projections to be snap-fitted into the housing recesses.

Figure 27:
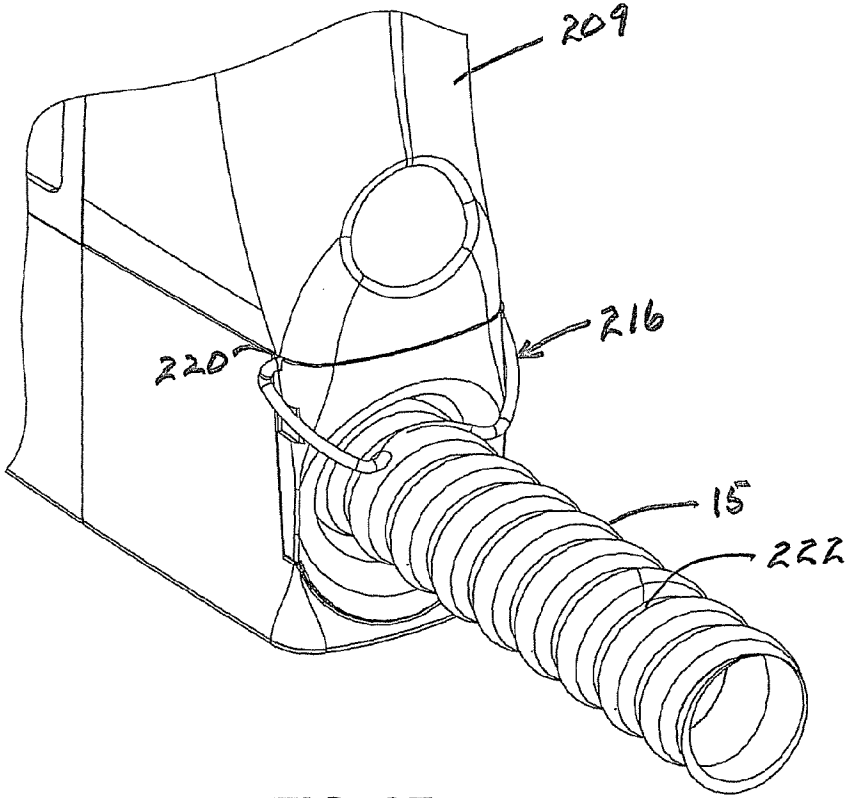
FIG. 27 is a view similar to FIG. 26 showing the one way hose latch in latched position with the hose.
Figure 26:
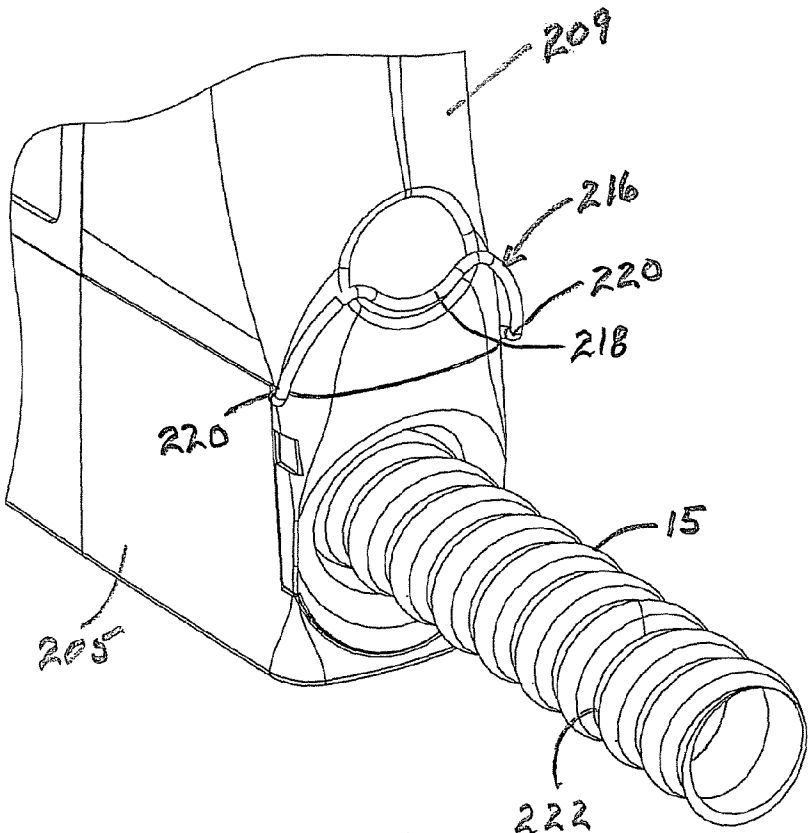
FIG. 26 is an enlarged fragmentary front perspective view showing the one way hose latch in a retracted non-engaged position.

In accordance with still another feature of embodiment 200, a one-way latch indicated generally at 216, is pivotally mounted on front wall 209 of housing 201 (FIGS. 26 and 27).

Latch 216 preferably is formed as a stiff metal wire having a curved central section 218 and two free ends 220 which project into two openings formed in the housing adjacent side walls 205 and 207 to pivotally mount latch 216 thereon. Curved central section 218, when in a latched position with hose 15 as shown in FIG. 27, extends into one of the grooves or valleys 222 formed in hose 15 by internal helical spring 21 as shown in FIGS. 12 and 13. To use latch 216, a user will merely pivot the latch downwardly to the latched position of FIG. 27 wherein curved central section 218 becomes engaged within one of the hose grooves 222. This enables a user to merely pull the hose outwardly from its collapsed position toward the extended position which will automatically enable the hose to move past the downwardly pivoted one-way latch. Upon release of this outward pulling pressure, central section 218 becomes trapped in the most recently engaged groove 222 preventing the movement of the hose toward a retracted position. This temporary retention will relieve all retraction pressure on the hose handle caused by the internal spring and vacuum source avoiding the user to continually apply a pulling force on the hose. Manual pivotal movement of latch 216 from its engaged latched position of FIG. 27 to its disengaged unlatched position of FIG. 26 will then enable the hose to be retracted into the storage compartment in one of the various manners discussed above. Latch 216 will not restrict the continued outward extension of hose 15 but only prevents movement in the retraction direction.

Thus, one-way latch 216 provides an extremely simple, inexpensive and easily used device for maintaining the hose in an extended position eliminating retraction force on the hose handle until retraction of the hose into the storage compartment is desired requiring only the simple manual pivotal movement of the one-way latch to the position of FIG. 26. Latch 216 can also be formed of a rigid plastic or have other configurations so long as it provides a portion which engages grooves 222 of the hose automatically as the hose is being pulled outwardly from the storage compartment yet which engagement within a selected groove will prevent retraction of the hose into the storage compartment until the latching component is moved out of engagement to an inactive stored position as shown in FIG. 26.

Figure 23:
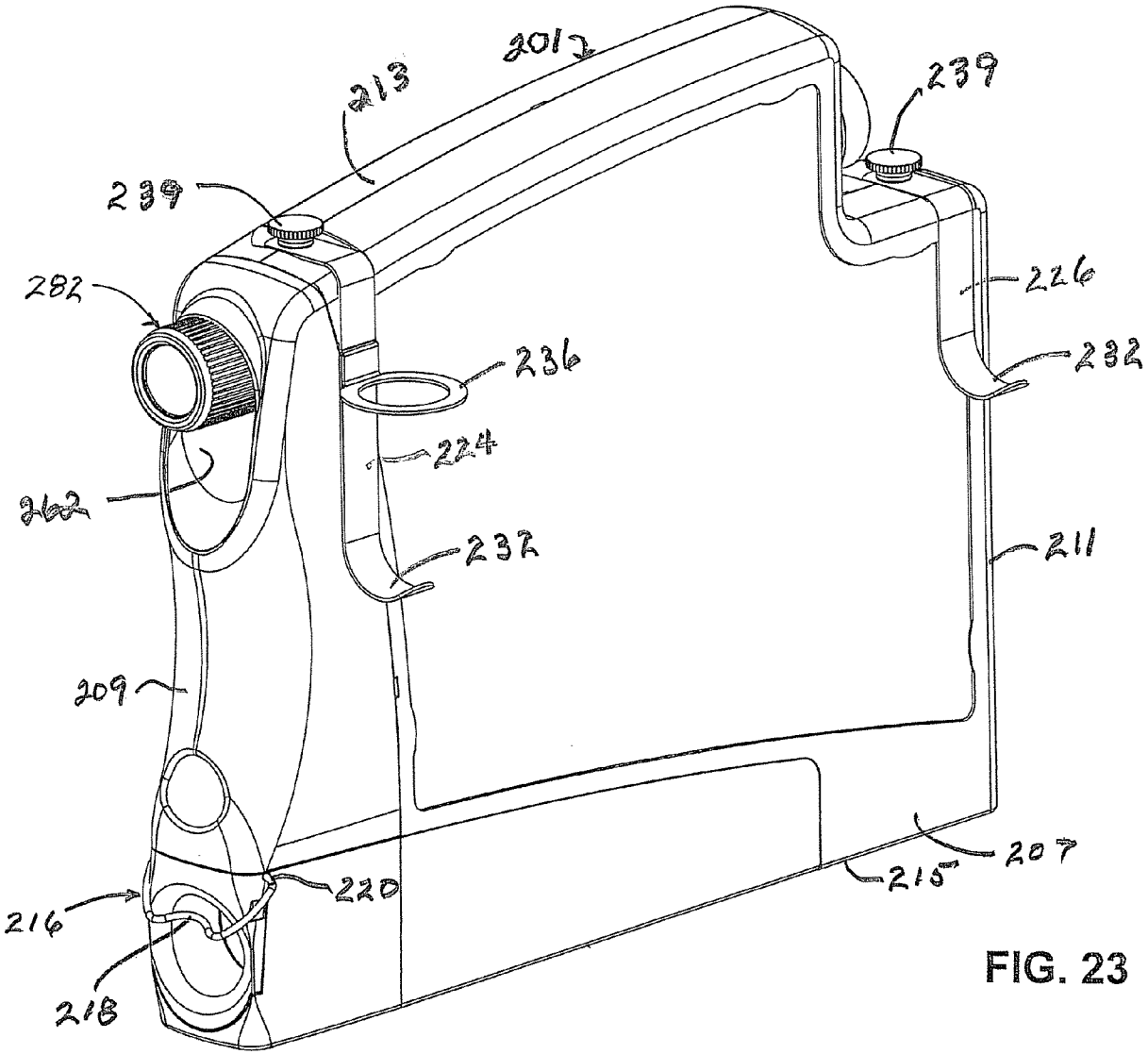
FIG. 23 is an opposite side perspective view of FIG. 22 showing a pair of tool holder brackets mounted thereon and the hose removed.
Figure 24:
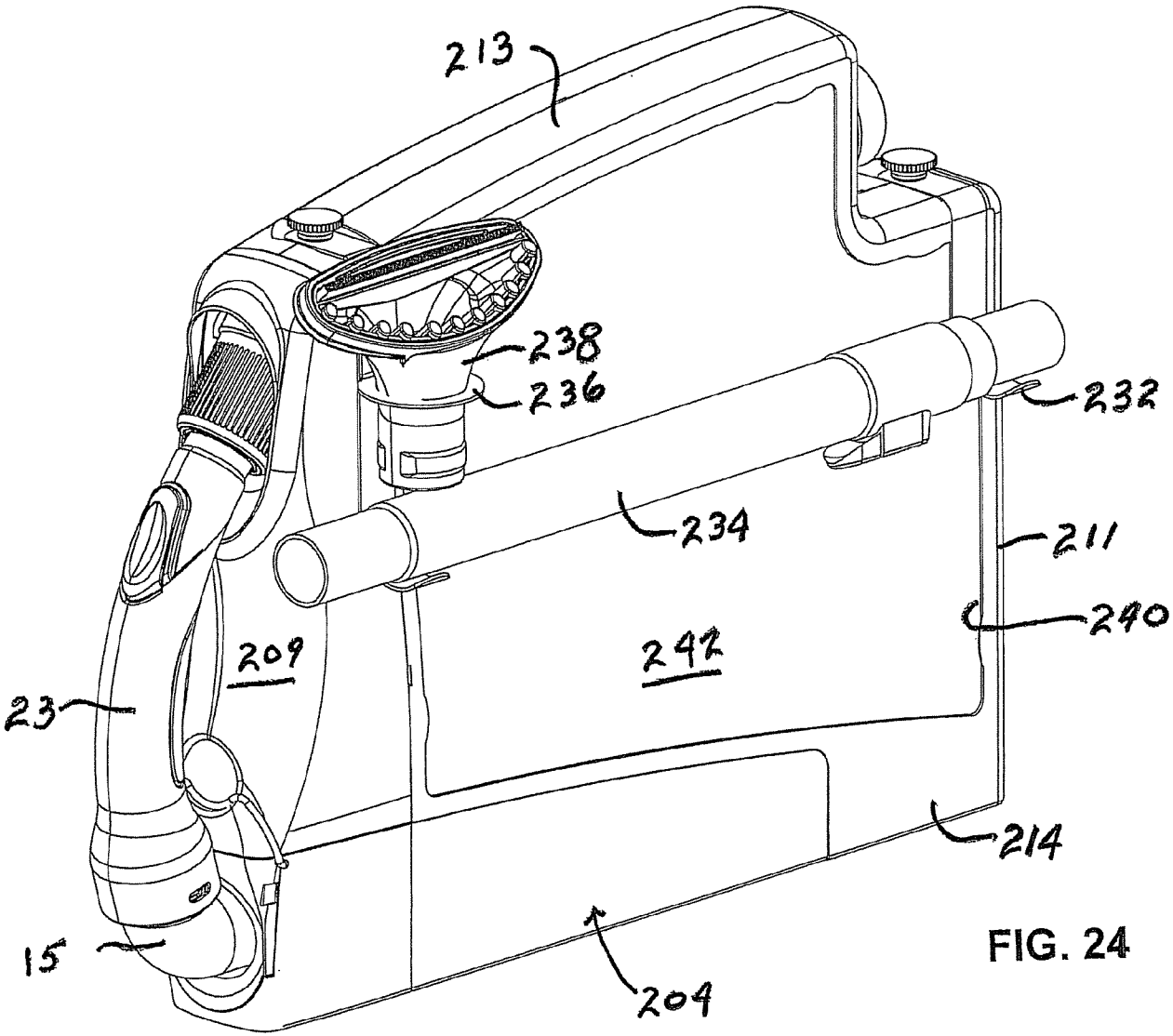
FIG. 24 is a perspective view similar to FIG. 23 showing a plurality of tools mounted on the tool holder brackets.
Figure 25:
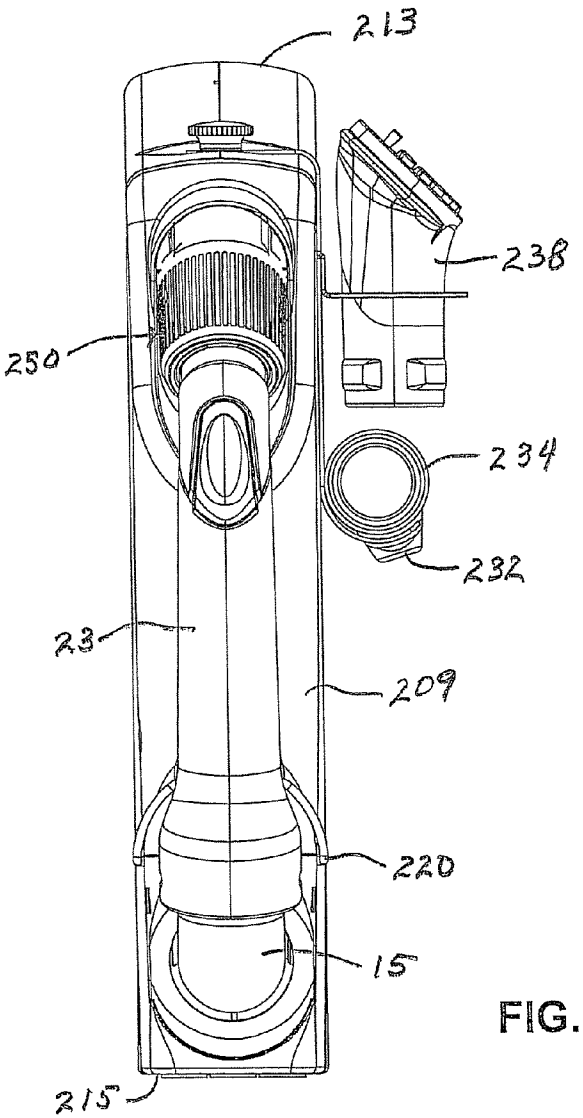
FIG. 25 is a front elevational view of FIG. 24.

Still another feature of embodiment 200 is the use of one or more tool-holding brackets 224 and 226 secured preferably on top wall 213 of housing 201 (FIG. 23). Tool-holding brackets 224 and 226 may be formed of a simple strip of metal or plastic preferably having an upturned end 232 for supporting a tool or cleaning attachment component 234 (FIG. 24). A ring 236 may also be provided on one of the tool-holding brackets for holding a cleaning brush 238. Brackets 224 and 226 preferably are attached to top wall 213 by thumb bolts 239 which are threadably received within threaded holes (not shown) formed in the housing top wall. Tool-holding brackets 224 and 226 may be formed of metal, plastic or similar materials and have various shapes and sizes depending upon the particular configuration of the cleaning attachment or tool to be supported thereon.

Another feature of embodiment 200 is the formation of shallow recesses 240 (FIG. 34) in housing side walls 206 and 208, which recesses define a majority of the area of the side walls. A complementary-shaped side wall panel 242 is mounted in each of the recesses 240 and preferably contains printed indicia of a decorative or instructional nature as to the use and operation of the vacuum storage system. Panels 242 are secured within recesses 240 preferably by snap-fit connections (not shown) or other type of easily releasable connection. Panels 242 preferably are formed of a thin lightweight plastic and will be installed by the homeowner or installer after removal of the housing 201 from a shipping box 244 as discussed further below.

Figure 35:
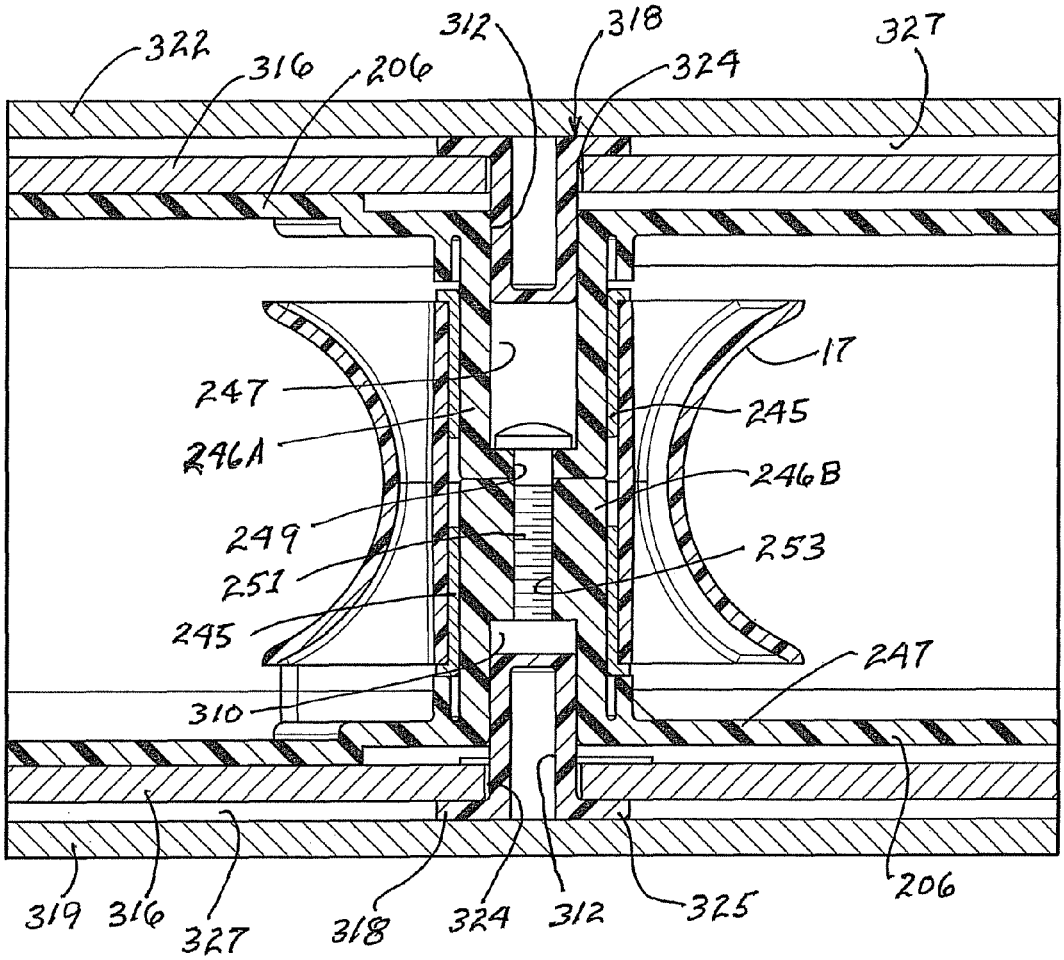
FIG. 35 is an enlarged fragmentary sectional view of the hose storage housing mounted within the shipping box of FIG. 34 showing one of the hose guide rollers rotatably mounted on one of the molded roller shafts.

Still another feature of embodiment 200 is the molding of a plurality of stub shafts 246 (FIGS. 28 and 35) on the interior surface of the opposed side walls 205 and 207 of housing 201. These stub shafts form a plurality of shafts 248 for rotatably supporting guide rollers 17 thereon eliminating the need of installing separate shafts thereby reducing production and material costs. Stub shafts 246 are formed integrally on side walls 205 and 207 and each has a cylindrical configuration and are designated as stub shafts 246A and 246B. Stub shaft 246A is formed with a hollow interior 247 and has a small bottom opening 249 through which a threaded bolt 251 extends into threaded engagement with a threaded opening 253 formed through the center of stub shaft 246B (FIG. 35). Stub shafts 246A and 246B are in opposed abutting relationship with bolt 251 securing the stub shafts together, as well as assisting and securing housing 201 in an assembled condition. Prior to securing the stub shafts together, a usual hose guide roller 17 is rotatably mounted thereon, preferably by a pair of spaced sleeve bearings 245.

Another very important addition in embodiment 200 is a vacuum control system having a control valve indicated generally at 250, which is mounted on a modified hose-receiving cradle 252. Cradle 252 is shown particularly in FIGS. 28, 29, and 30. Cradle 252 includes a tube section 254 preferably having a tapered bore 256 for slidably receiving the end of hose handle 23 therein. This tapered bore configuration provides a sliding generally air tight seal for receiving the end of handle 23. Tube section 254 is secured to ring 258 which is pivotally mounted by a pivot 260 between housing side walls 205 and 207 and extends outwardly through an opening 262 formed in housing front wall 209. Ring 258 is formed with a plurality of teeth 264 extending throughout the majority of its circumference. A boss 266 is formed integrally on an elongated slide strip 268 which is slidably received within a groove 270 formed in tube section 254. Boss 266 is slidably received within a slot 272 formed in a cylindrical collar 274. Collar 274 is telescopically rotatably and slidably mounted on tube section 254 and is provided with a series of teeth 276 formed about an open rear end thereof. Teeth 276 are adapted to releasably and selectively engage teeth 264 as discussed further below.

A stop ring 278 is affixed to a grooved end 280 of tube section 254 to maintain cylindrical collar 274 on tube section 254. A control knob 282 is secured to the outer end of collar 274 and is formed with a through bore 284 through which the end of hose handle 23 is inserted when entering tapered bore 256 of tube section 254. Control knob 282 preferably is provided with a plurality of axially extending ridges and grooves 286 for ease of grasping and manipulating knob 282 by a user for controlling the vacuum applied to internal hose 15 and subsequently to handle 23 as discussed further below.

Figure 31:
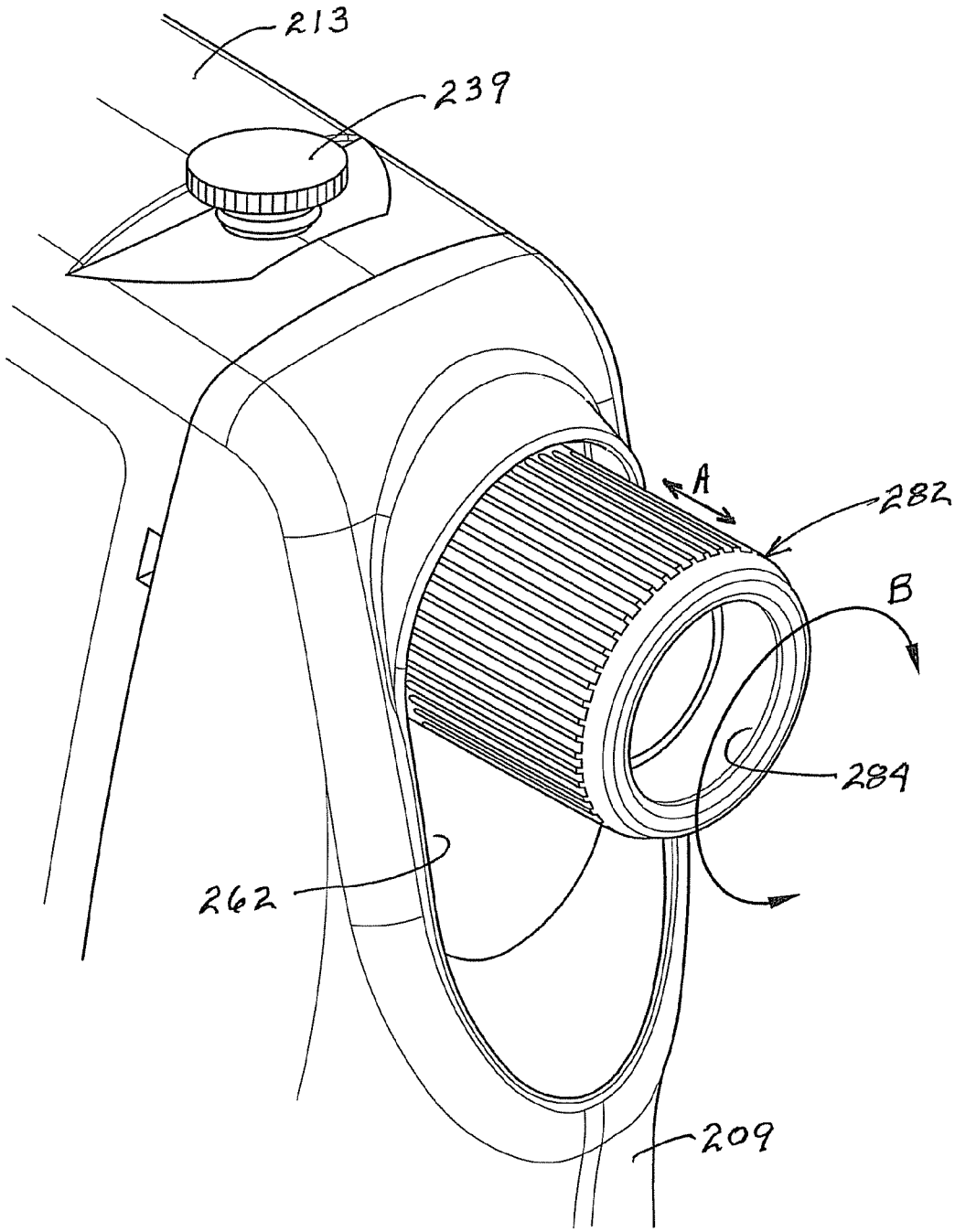
FIG. 31 is a fragmentary front perspective view of the vacuum control knob for the vacuum control system.
Figure 32:
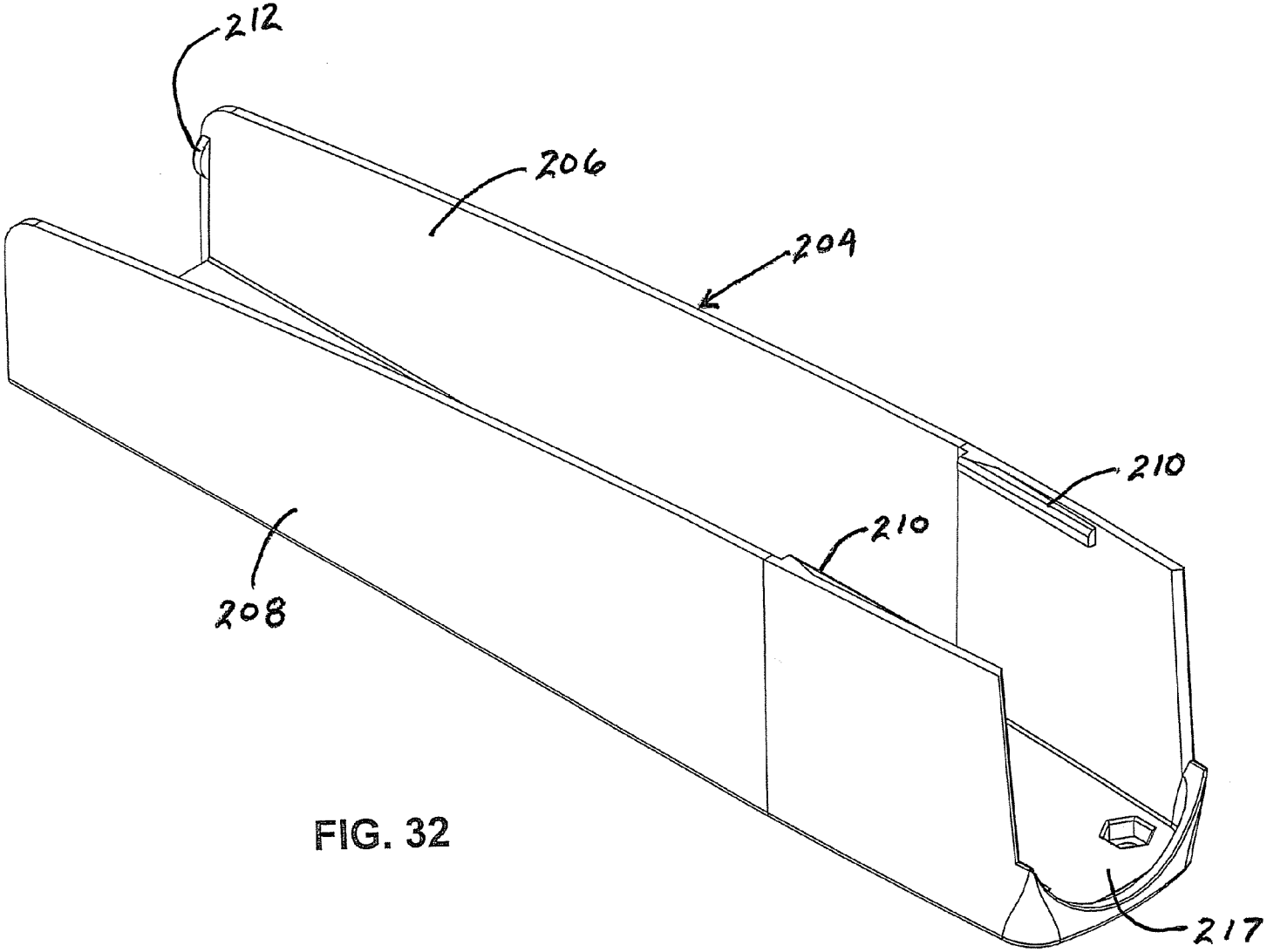
FIG. 32 is an enlarged perspective view of the U-shaped bracket for mounting the hose storage housing in a cabinet.
Figure 33:
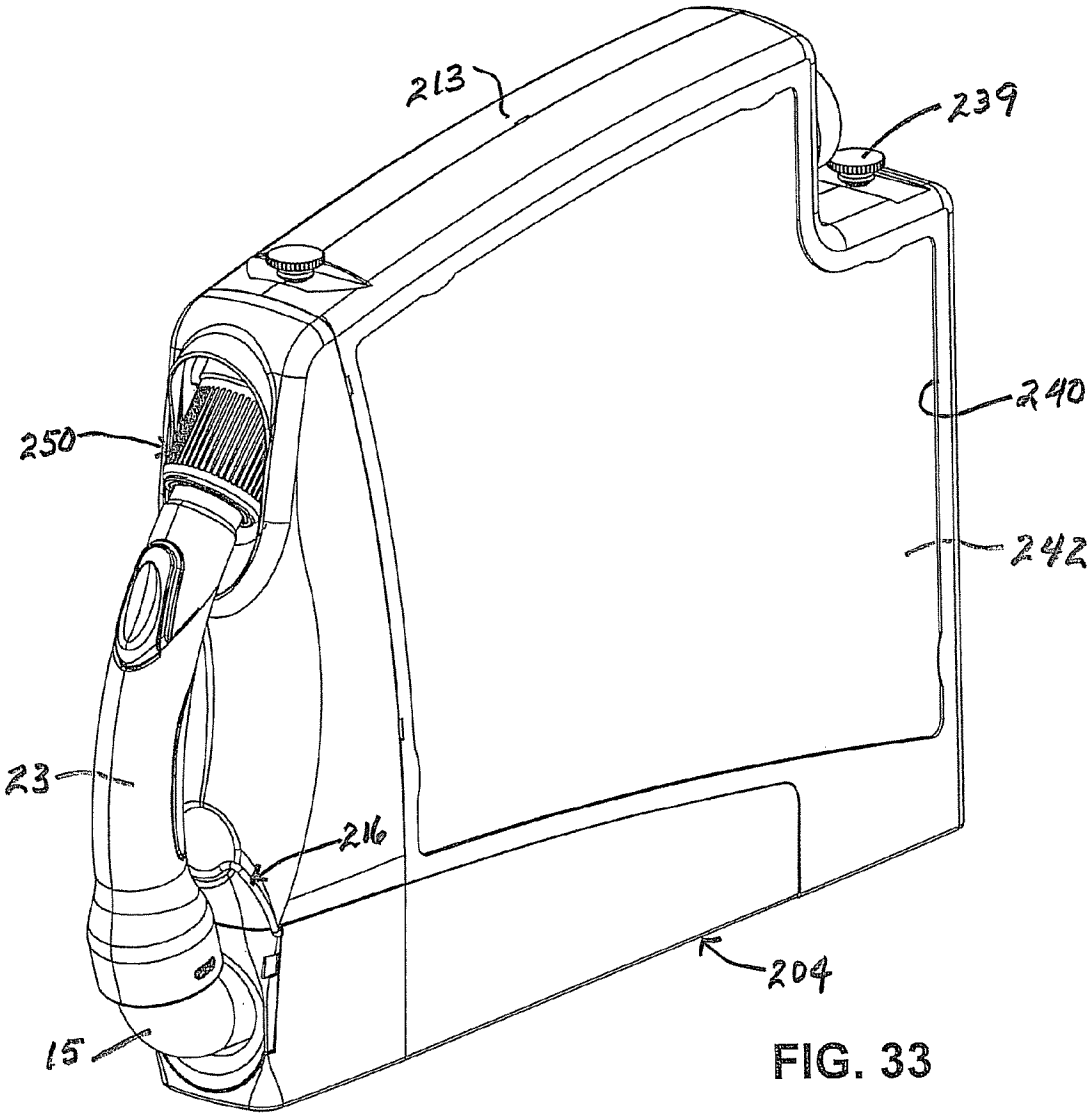
FIG. 33 is a perspective view of the hose storage housing connected to the U-shaped bracket of FIG. 32.

Control knob 282 is movable both in an axial direction as shown by Arrow A and in a rotational direction B (FIG. 31). Pulling outwardly on control knob 282 in the forward direction of Arrow A will slide cylindrical collar 274 including strip 268 and boss 266 along tube section 254 in groove 270 until stopped by stop ring 278. This outward axial movement disengages teeth 264 and 276 enabling knob 282 to be rotated in the direction of Arrow B which will change the position of boss 266 in slot 272. Strip 268 is connected to a control cable 288 (FIGS. 28 and 28A) which passes along the interior of the housing and through an eyelet 290 until terminating and secured to a connector 292.

Connecter 292 is secured to a collar 294 which is coaxial with and slidably mounted on a short section of tube 296. Tube 296 is the vacuum connection tube which connects hose 15 to a vacuum source. Tube 296 has an outer open end 298 which preferably extends outwardly from the rear wall 211 of housing 201 for subsequent connection to a vacuum connection tube such as tubing 35 as shown in FIG. 7. Tube 296 is secured within an opening (not shown) in the rear wall of housing 201 by a mounting collar 300 or other type of connection. Connection tube 296 is formed with a plurality of air exhaust holes 302 and may have a threaded end opening 304 for ease of connection to hose 15. A spring 306 extends between connector 292 and collar 300 and biases collar 294 in the direction of Arrow C (FIG. 28A).

Figure 28:
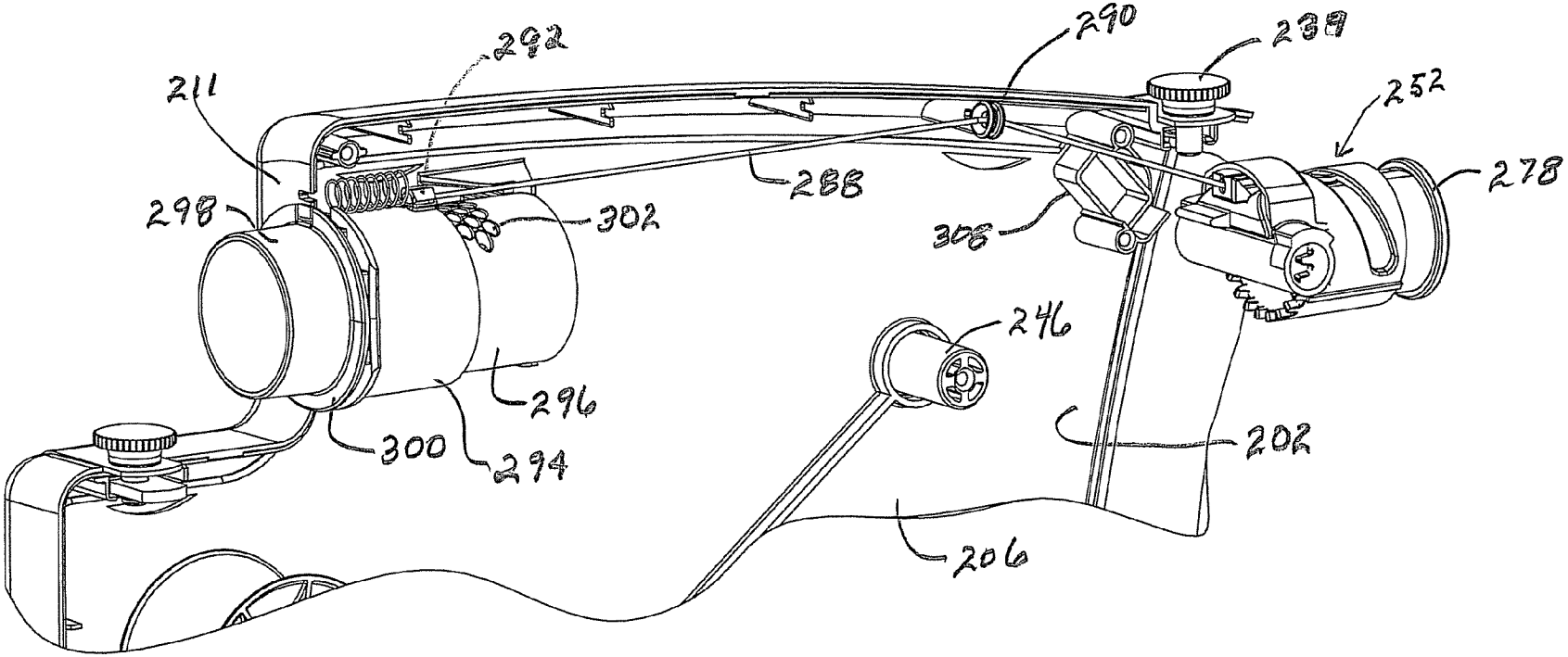
FIG. 28 is a fragmentary perspective view of the upper portion of the hose storage housing with the side wall removed showing the vacuum control mechanism.
Figure 28A:
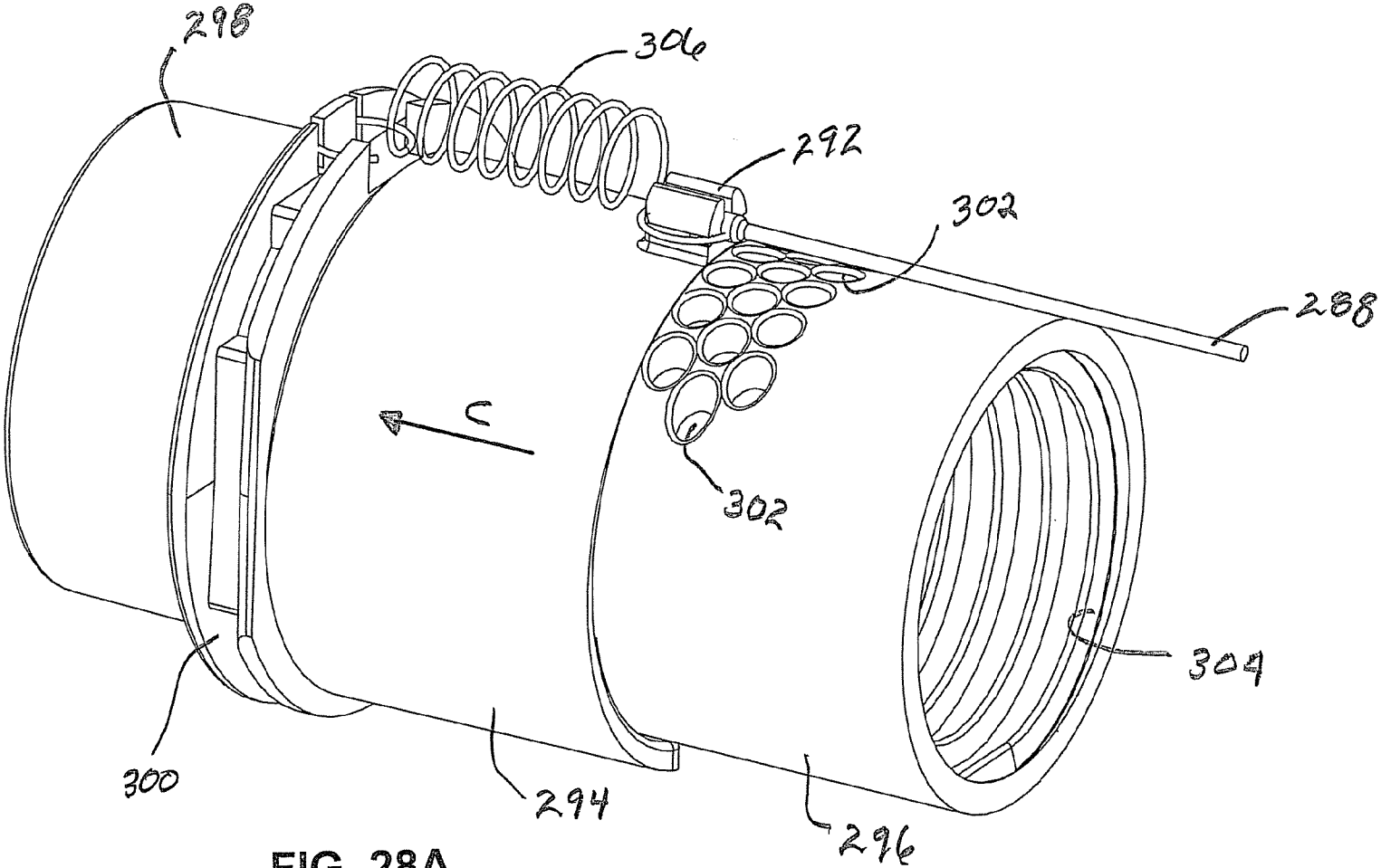
FIG. 28A is an enlarged fragmentary view of the rear portion of the vacuum control system shown in FIG. 28.
Figure 29:
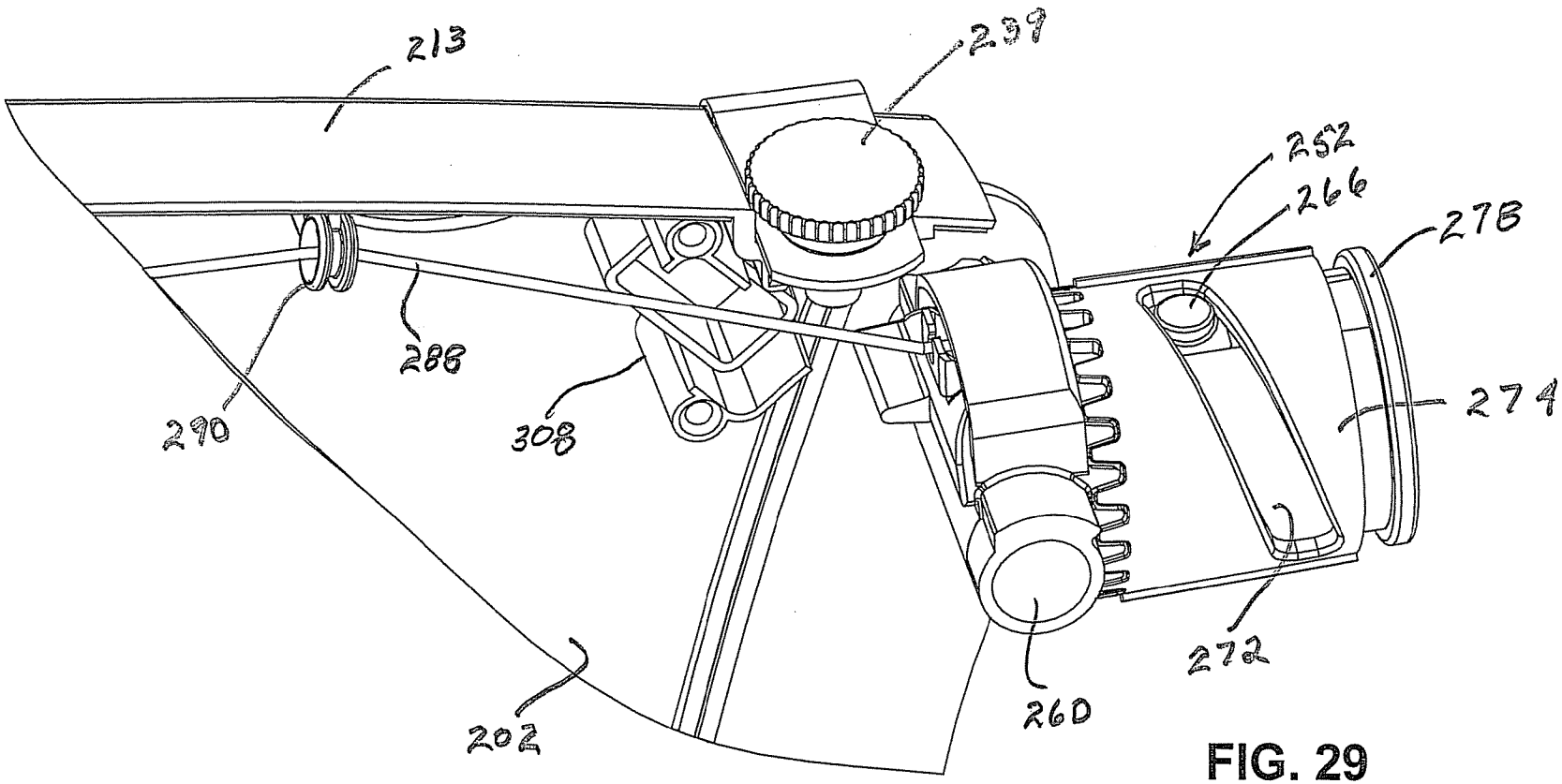
FIG. 29 is an enlarged fragmentary view of the front portion of the vacuum control system shown in FIG. 28.
Figure 30:
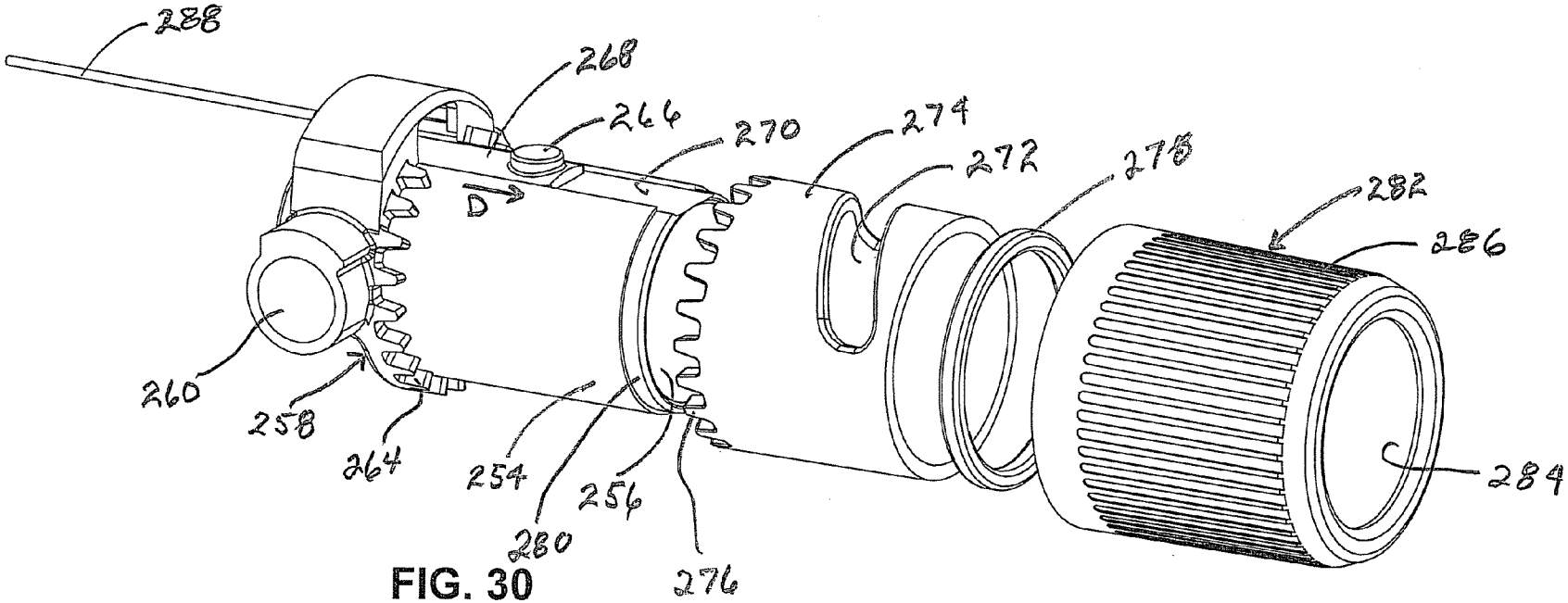
FIG. 30 is an exploded view of the front portion of the vacuum control system removed.

The operation of the vacuum control system is shown particularly in FIGS. 28-31. As discussed above, a source of vacuum is connected to tube end 298 and subsequently to hose 15 through the hose connection to vacuum tube 296 at open end 304. The user wishing to change the strength of the vacuum source which is subsequently applied to handle 23 of hose 15 will pull axially outwardly on control knob 282 which will move cylindrical collar 274 and slide strip 268 and boss 266 axially along tube section 254 and disengage teeth 276 from teeth 264. Knob 282 is then rotated which will rotate attached collar 274 resulting in boss 266 moving along slot 272 which will subsequently move boss 266 and strip 268 in the direction of Arrow D (FIG. 30). Axial movement of strip 268 will move attached cable 288 and subsequently attached collar 294 (FIG. 28A) along vacuum connection tube 296. Movement of collar 294 will either cover or expose more holes 302 depending upon its direction of movement thereby controlling the strength of the vacuum due to the amount of holes which communicate with the surrounding atmosphere within storage compartment 202. Thus, if more holes 302 are exposed upon the movement of collar 294, the vacuum applied to the open end of handle 23 will be reduced and vice versa the more holes 302 that are covered by collar 294 will increase the strength of the vacuum at the open end of handle 23.

Thus, a user merely grasps control knob 282 and slides it slightly outwardly and rotates it in either direction for increasing or decreasing the vacuum force on handle 23 by the movement of boss 266 and strip 268 and subsequently the sliding movement of control collar 294 along tube 296 through cable 288. Upon the inward movement of control knob 282 and subsequently cylindrical collar 274, the engagement of teeth 276 with teeth 264 on pivot collar 258 will set the control knob at a desired position. Thus, the vacuum control system enables the user to easily control the strength of the vacuum source by the mere axial movement and rotation of control knob 282 and once it is adjusted will remain at the desired strength until a readjustment is desired.

A control switch holder 308 is pivotally mounted adjacent to the vacuum control mechanism as shown in FIGS. 28 and 29, for mounting an ON/OFF switch (not shown) similar to switch 53 discussed above.

Still another feature of embodiment 200 is the formation of a plurality of holes 312 in each side wall of housing 201 provided by the hollow interiors 247 and 310 of stub shafts 246A and 246B. Holes 312 are formed easily in the side walls when molding the stub shafts thereon. Holes 312 facilitate the packaging and shipping of housing 201 as shown particularly in FIGS. 34 and 34A. Each housing 201 preferably is contained and shipped in a separate shipping box 314. Box 314 will have a usual parallelepiped configuration with spaced end walls 315, side walls 317 and a bottom wall 319 forming an internal storage compartment 320 preferably closed by four top closure flaps 322. A pair of shipping panels 316, preferably formed of a corrugated cardboard material as is box 314, are used for securing housing 201 safely within storage compartment 320. Each panel 316 has a dimension equal to the inside dimension of box 314.

A plurality of studs 318 (FIGS. 34 and 35) are inserted through a plurality of holes 324 formed in each shipping panel 316 and extend into side wall holes 312 formed by stub shaft interiors 247 and 310. Housing 201 then is placed in the box storage compartment with studs 318 extending into holes 312 which are aligned therewith. Next an upper panel 316 is placed onto the opposite side of housing 201 with studs 318 extending through panel holes 324 trapping housing 201 therebetween as shown particularly in FIG. 35. Studs 318 preferably have an annular flange 325 which will place shipping panels 316 in a slightly spaced relationship shown by spacing 327 from box bottom wall 319 and the adjacent closure flap 322. This provides a slight crush zone between the sides of housing 201 and shipping box 314.

Figure 34:
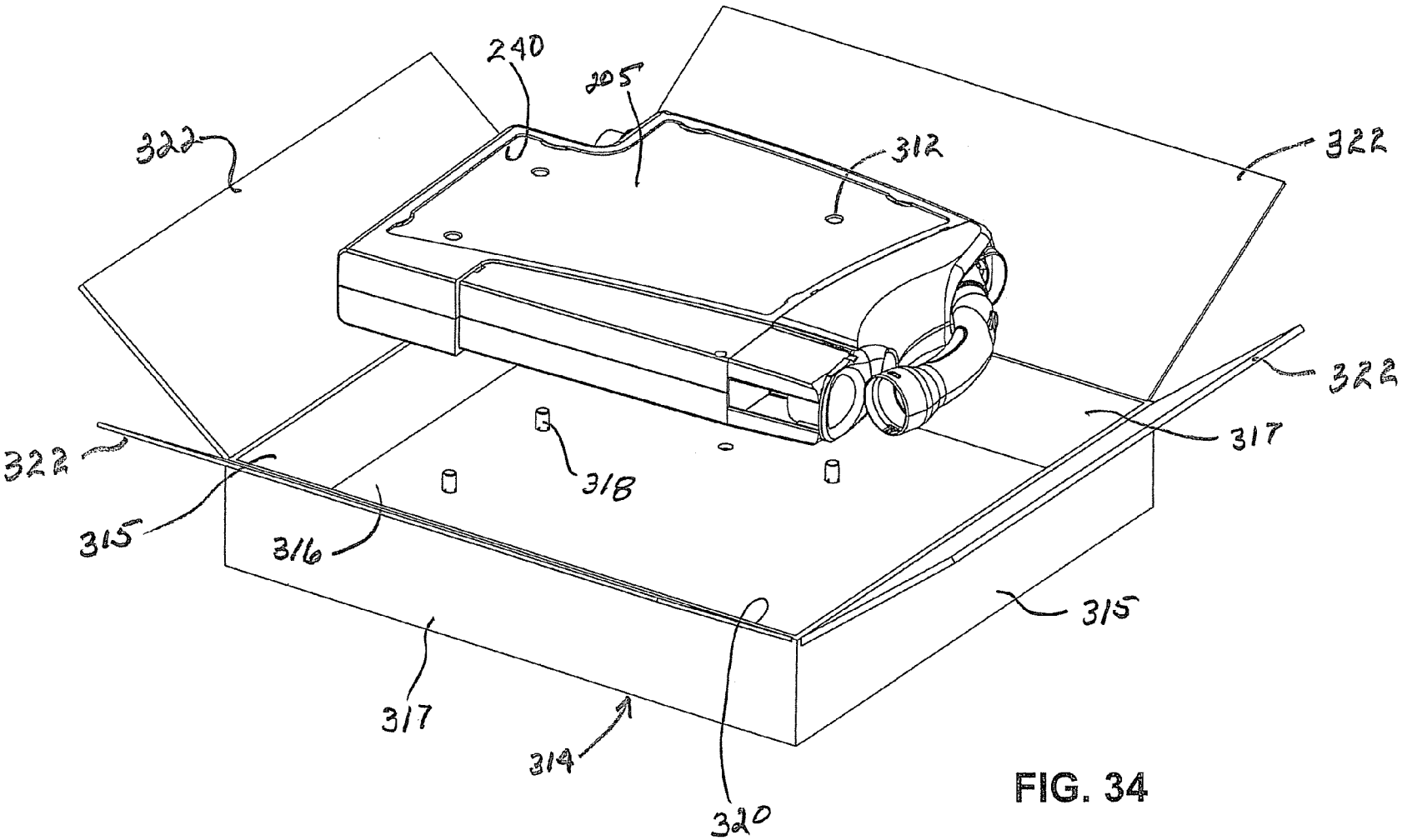
FIG. 34 is an exploded perspective view of the hose storage housing being placed in a shipping box.
Figure 34A:
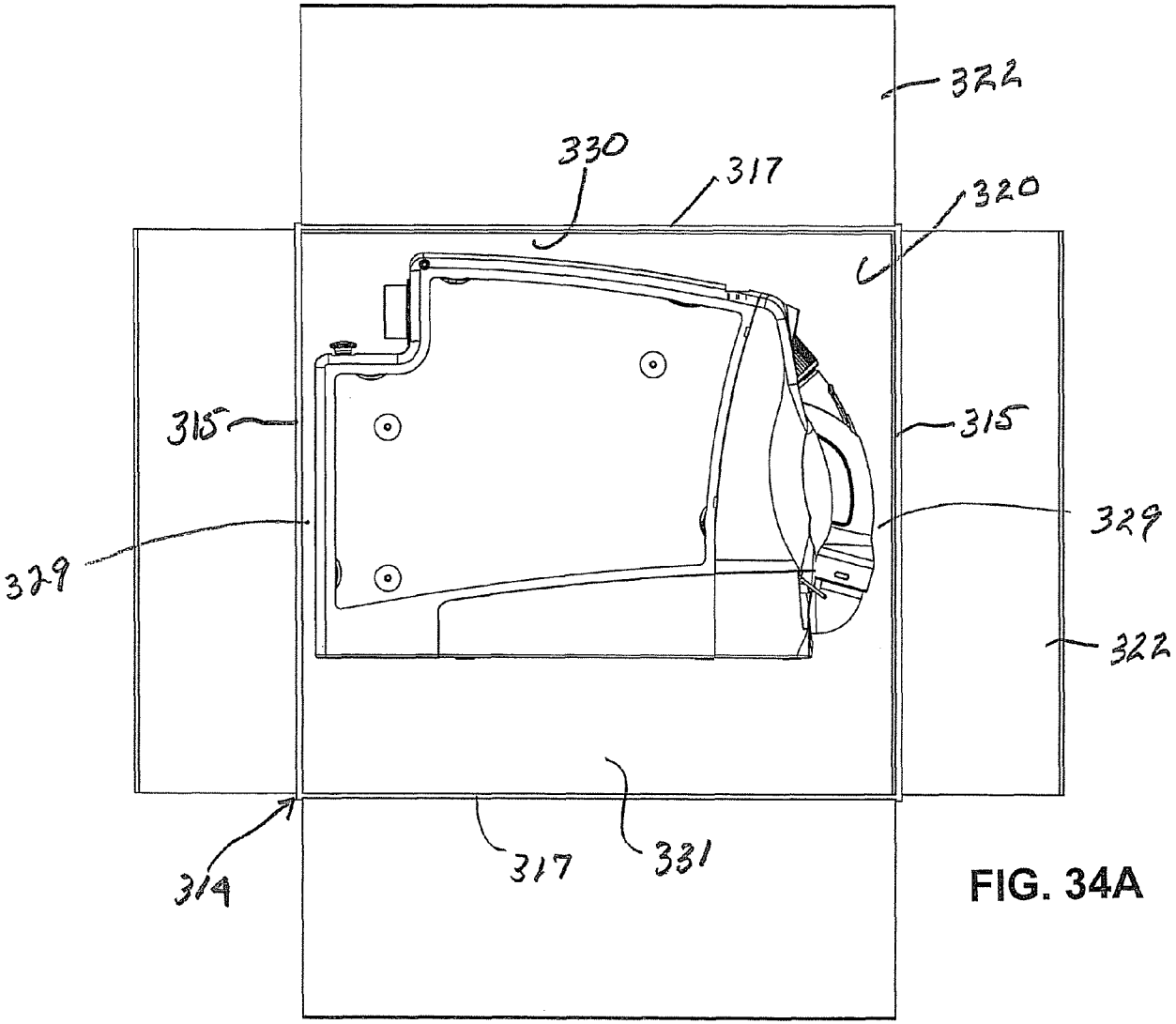
FIG. 34A is a top plan view of the hose storage housing placed in the shipping box with the top shipping panel and housing side panel removed.

Furthermore, as shown in FIG. 34A, when housing 201 is placed within shipping box 314 and aligned therein by the insertion of studs 318 in holes 312, a space 329 will be provided between the front and back walls of housing 201 and side walls 315 of box 314. Furthermore, a spacing 330 will be provided between the top of housing 201 and wall 317 of box 314. Preferably, a larger open space 331 is provided between the bottom of housing 201 and box side wall 317 than the spacing provided adjacent the other three sides of housing 201 to provide space large enough to accommodate some floor tools that may be shipped in the shipping box. These spaces provide crush zones providing additional protection to housing 201 eliminating the need for additional package material and the expenses associated therewith. This feature again is provided during the molding of guide wheel roller stub shafts 246.

A second shipping panel 316 (not shown in FIGS. 34 and 34A) will be shipped separately in storage compartment 320 of shipping box 314 and will be snap-fitted into one or both of the shallow recesses 240 prior to installing housing 201 in mounting bracket 204 or other type of mounting assembly. Preferably, one of the snap-in panels 242 will have operating instructions or other indicia printed thereon and this will be placed in the recess on the exposed side of the housing which is easily visualized by inspection of FIG. 1, so as to be readily seen by the homeowner and user of the improved vacuum hose storage system.

Thus, the third embodiment 200 of the improved hose storage system provides a considerable number of additional advantages than the hose storage system of embodiment 1, and in particular, the vacuum strength control valve facilitated by control knob 282; the one-way hose latch 216 provided by the inexpensive and the pivotally mounted stiff wire; the ease of incorporation of sundry tool holders attached by thumb bolts 239 to the housing top wall; the removable side panels 242 which are snap-fitted into one or more of the pair of recesses 240; the U-shaped mounting bracket 204 which snap-fittedly mounts housing 201 within a storage cabinet; and the molding of the pair of opposed stub shafts for forming hose reel shaft 248 for the rotatable mounting of hose guide rollers 17 thereon.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A vacuum hose storage system comprising:

a housing forming an internal storage compartment;

a length of hose extendable from a retracted position in the storage compartment to an extended position extending from said storage compartment, said hose having a first end adapted to be connected to a vacuum source and an open second end for collecting dirt from an area to be cleaned;

a handle on the second end of the hose;

a cradle on the housing for holding the handle when the hose is in the retracted position;

a helical spring located within the hose providing a biasing force for retracting the hose toward the retracted position; and a one-way latch mounted on the housing and operatively engageable with the helical spring of the hose permitting the hose to move freely toward the extended position from the storage compartment while preventing movement of the hose toward the retracted position when in an engaged position with the hose.

2. The vacuum hose storage system defined in claim 1 wherein the one-way latch is a pivotally mounted rigid wire having a curved section which operatively engages the helical spring to secure the hose in an extended position.

* * * * *